US009324283B2

(12) United States Patent
Kabe et al.

(10) Patent No.: US 9,324,283 B2
(45) Date of Patent: Apr. 26, 2016

(54) DISPLAY DEVICE, DRIVING METHOD OF DISPLAY DEVICE, AND ELECTRONIC APPARATUS

(71) Applicant: Japan Display Inc., Tokyo (JP)

(72) Inventors: Masaaki Kabe, Tokyo (JP); Toshiyuki Nagatsuma, Tokyo (JP); Amane Higashi, Tokyo (JP); Kojiro Ikeda, Tokyo (JP); Tae Kurokawa, Tokyo (JP); Masashi Mitsui, Tokyo (JP); Hiroki Uchiyama, Tokyo (JP); Hirokazu Tatsuno, Tokyo (JP); Fumitaka Goto, Tokyo (JP); Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 82 days.

(21) Appl. No.: 14/086,476

(22) Filed: Nov. 21, 2013

(65) Prior Publication Data

US 2014/0168284 A1 Jun. 19, 2014

(30) Foreign Application Priority Data

Dec. 19, 2012 (JP) ..... 2012-277238
Mar. 22, 2013 (JP) ..... 2013-061017

(51) Int. Cl.
*G09G 3/34* (2006.01)
*G09G 3/36* (2006.01)
*G09G 3/20* (2006.01)

(52) U.S. Cl.
CPC ..... *G09G 3/3607* (2013.01); *G09G 3/3648* (2013.01); *G09G 3/2003* (2013.01); *G09G 2300/0452* (2013.01);

(Continued)

(58) Field of Classification Search
None
See application file for complete search history.

(56) References Cited

U.S. PATENT DOCUMENTS 7,273,286 B2 * 9/2007 Ikebe et al. ..... 353/85
8,743,152 B2 6/2014 Sakaigawa (Continued)

FOREIGN PATENT DOCUMENTS

CN 102339587 2/2012
JP 2010020241 1/2010

(Continued)

OTHER PUBLICATIONS

Notification of the First Office Action issued in connection with Chinese Patent Application No. 2013106905563, dated Jul. 13, 2015. (14 pages).

(Continued)

*Primary Examiner* — Antonio Xavier
(74) *Attorney, Agent, or Firm* — K&L Gates LLP

(57) ABSTRACT

According to an aspect, a display device includes a first sub-pixel, a second sub-pixel, a third sub-pixel; and a fourth sub-pixel. A signal obtained based on at least an input signal for the first sub-pixel and an extension coefficient is supplied to the first sub-pixel. A signal obtained based on at least an input signal for the second sub-pixel and the extension coefficient is supplied to the second sub-pixel. A signal obtained based on at least an input signal for the third sub-pixel and the extension coefficient is supplied to the third sub-pixel. A signal obtained based on at least the input signal for the first sub-pixel, the input signal for the second sub-pixel, the input signal for the third sub-pixel, and the extension coefficient is supplied to the fourth sub-pixel. The extension coefficient varies based on at least a saturation of the input signals.

6 Claims, 13 Drawing Sheets

(52) U.S. Cl.
CPC ... *G09G 2320/0242* (2013.01); *G09G 2340/06* (2013.01); *G09G 2360/16* (2013.01)

(56) References Cited

U.S. PATENT DOCUMENTS

| | | | | |
|---|---|---|---|---|
| 2006/0262251 | A1* | 11/2006 | Kim et al. | 349/106 |
| 2009/0002298 | A1* | 1/2009 | Furukawa | 345/88 |
| 2009/0315921 | A1* | 12/2009 | Sakaigawa et al. | 345/694 |
| 2009/0322802 | A1* | 12/2009 | Noguchi et al. | 345/694 |
| 2010/0007679 | A1* | 1/2010 | Sakaigawa | 345/690 |
| 2012/0013649 | A1* | 1/2012 | Higashi et al. | 345/690 |

FOREIGN PATENT DOCUMENTS

| | | |
|---|---|---|
| JP | 2012-022217 | 2/2012 |
| JP | 2012-108518 | 6/2012 |

OTHER PUBLICATIONS

Office Action issued in JP application 2013-061017, mailed Jan. 26, 2016 (7 pages).

* cited by examiner

DISPLAY DEVICE, DRIVING METHOD OF DISPLAY DEVICE, AND ELECTRONIC APPARATUS

CROSS REFERENCES TO RELATED APPLICATIONS

The present application claims priority to Japanese Priority Patent Application JP 2012-277238 filed in the Japan Patent Office on Dec. 19, 2012, and JP 2013-061017 filed in the Japan Patent Office on Mar. 22, 2013, the entire content of which is hereby incorporated by reference.

BACKGROUND

1. Technical Field

The present disclosure relates to a display device, a driving method thereof, and an electronic apparatus including the display device.

2. Description of the Related Art

Recent years have seen a growing demand for display devices for use in, for example, mobile devices such as mobile phones and electronic paper. In a display device, a single pixel includes a plurality of sub-pixels, each of which emits light of a different color. The single pixel displays various colors by switching on and off display of the sub-pixels. Such display devices have been improved year after year in display properties such as resolution and luminance. However, an increase in the resolution reduces an aperture ratio, and thus increases necessity for increase in luminance of a backlight to achieve high luminance, causing a problem of increase in power consumption of the backlight. There is a technique (such as Japanese Patent Application Laid-open Publication No. 2012-108518) to improve this in which a white sub-pixel as a fourth sub-pixel is added to the conventional sub-pixels of red, green, and blue. This technique reduces the current value of the backlight by an increase in the luminance with the white sub-pixel, and thereby reduces the power consumption. The white sub-pixel increases the luminance when the current value of the backlight is not reduced. Thus, there is a technique (such as Japanese Patent Application Laid-open Publication No. 2012-22217 ([JP-A-2012-22217]) that uses this to improve visibility under outside light of outdoors.

The technique of JP-A-2012-22217 changes an extension coefficient for extending an input signal according to brightness of the input signal. For example, the extension coefficient is set larger on the side where the brightness is low, that is, on the low-gradation side, and is set smaller on the side where the brightness is high, that is, on the high-gradation side. This results in increasing the luminance on the low-gradation side, thus improving the visibility of the display device in outdoors. However, the technique of JP-A-2012-22217 applies an always constant value of the extension coefficient to saturation, and thus can cause a reduction (deterioration) in display quality, such as gradation collapse and change in color, on the high-saturation side.

For the foregoing reasons, there is a need for suppressing a reduction in visibility of a display device while reducing deterioration in display quality of the display device, under outside light.

SUMMARY

According to an aspect, a display device includes a first sub-pixel, a second sub-pixel, a third sub-pixel; and a fourth sub-pixel. A signal obtained based on at least an input signal for the first sub-pixel and an extension coefficient is supplied to the first sub-pixel. A signal obtained based on at least an input signal for the second sub-pixel and the extension coefficient is supplied to the second sub-pixel. A signal obtained based on at least an input signal for the third sub-pixel and the extension coefficient is supplied to the third sub-pixel. A signal obtained based on at least the input signal for the first sub-pixel, the input signal for the second sub-pixel, the input signal for the third sub-pixel, and the extension coefficient is supplied to the fourth sub-pixel. The extension coefficient varies based on at least a saturation of the input signals.

According to another aspect, a driving method is for a display device that comprises a first sub-pixel, a second sub-pixel, a third sub-pixel, and a fourth sub-pixel. The driving method includes: supplying a signal obtained based on at least an input signal for the first sub-pixel and an extension coefficient to the first sub-pixel; supplying a signal obtained based on at least an input signal for the second sub-pixel and the extension coefficient to the second sub-pixel; supplying a signal obtained based on at least an input signal for the third sub-pixel and the extension coefficient to the third sub-pixel; supplying a signal obtained based on at least the input signal for the first sub-pixel, the input signal for the second sub-pixel, the input signal for the third sub-pixel, and the extension coefficient to the fourth sub-pixel; and changing the extension coefficient based on at least a saturation of the input signals.

According to another aspect, an electronic apparatus includes a first sub-pixel, a second sub-pixel, a third sub-pixel, a fourth sub-pixel, and a processing unit. The processing unit is configured to supply a signal obtained based on at least an input signal for the first sub-pixel and an extension coefficient to the first sub-pixel, supply a signal obtained based on at least an input signal for the second sub-pixel and the extension coefficient to the second sub-pixel, supply a signal obtained based on at least an input signal for the third sub-pixel and the extension coefficient to the third sub-pixel, supply a signal obtained based on at least the input signal for the first sub-pixel, the input signal for the second sub-pixel, the input signal for the third sub-pixel, and the extension coefficient is supplied to the fourth sub-pixel, and change the extension coefficient based on at least a saturation of the input signals.

Additional features and advantages are described herein, and will be apparent from the following Detailed Description and the figures.

DETAILED DESCRIPTION

An embodiment for practicing the disclosure will be described in detail with reference to the accompanying drawings. The description will be made in the following order.

1. Configuration of Display Device
2. Processing Operation of Display Device
3. Setting of Extension Coefficient
4. Application Examples (Electronic Apparatus)
5. Aspects of Disclosure

1. Configuration of Display Device

Figure 1:
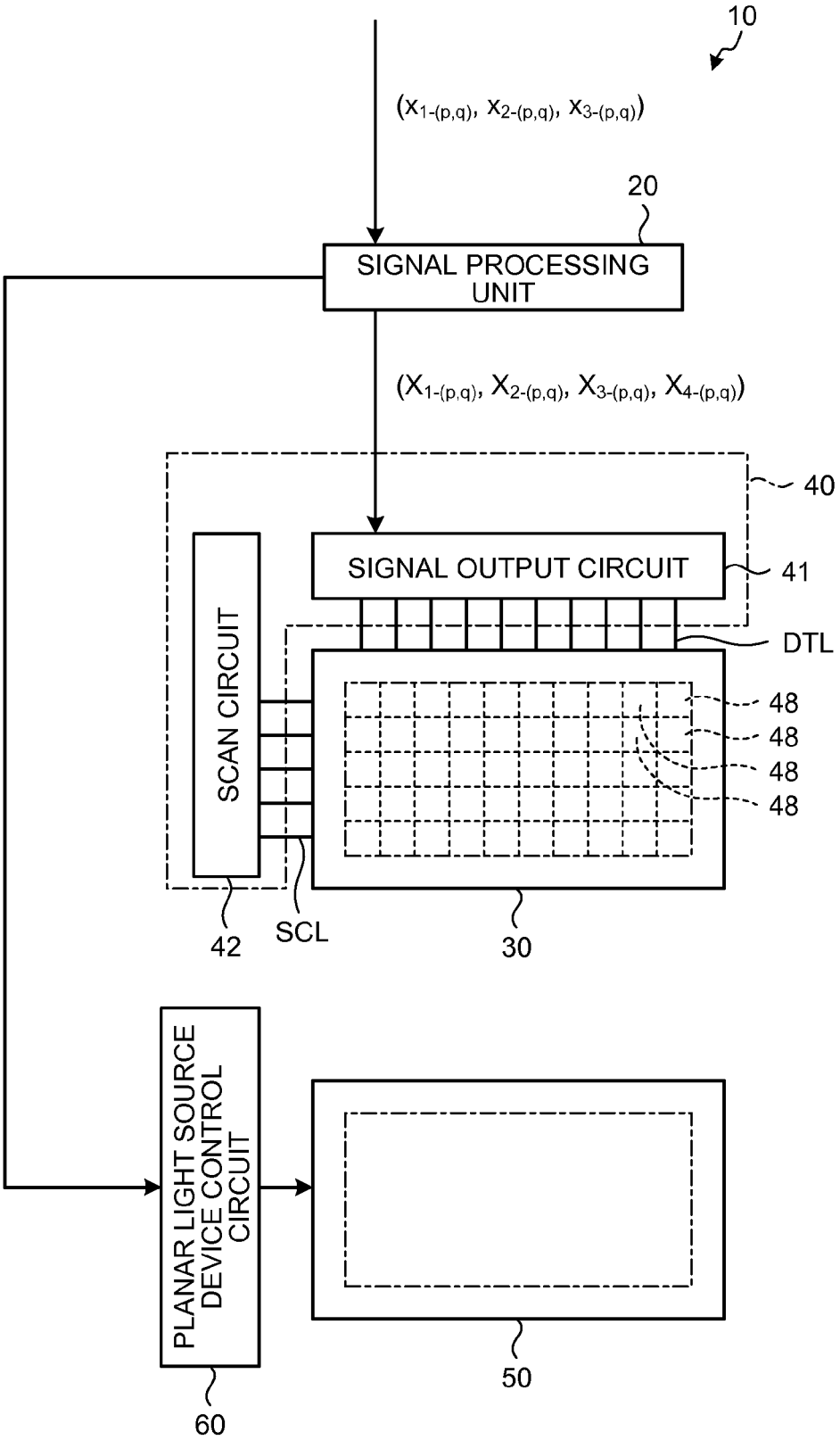
FIG. 1 is a block diagram illustrating an example of a configuration of a display device according to an embodiment.
Figure 2:
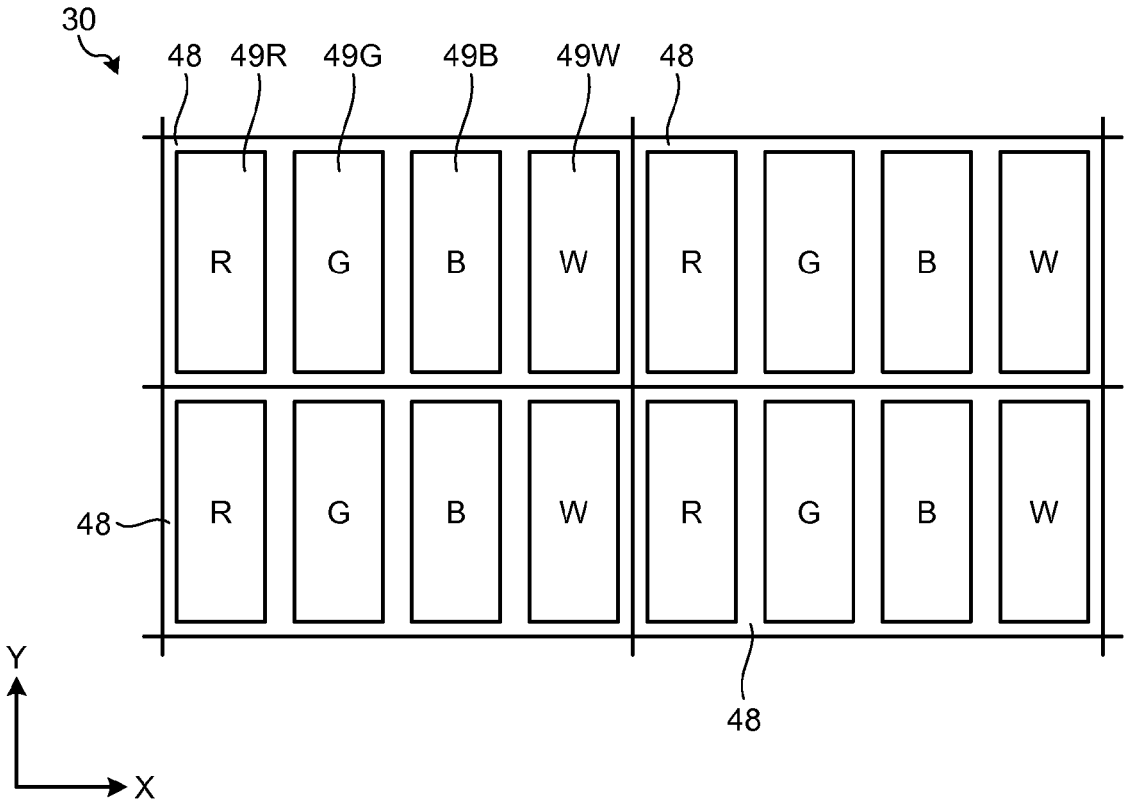
FIG. 2 is a diagram illustrating a pixel array of an image display panel according to the embodiment.
Figure 3:
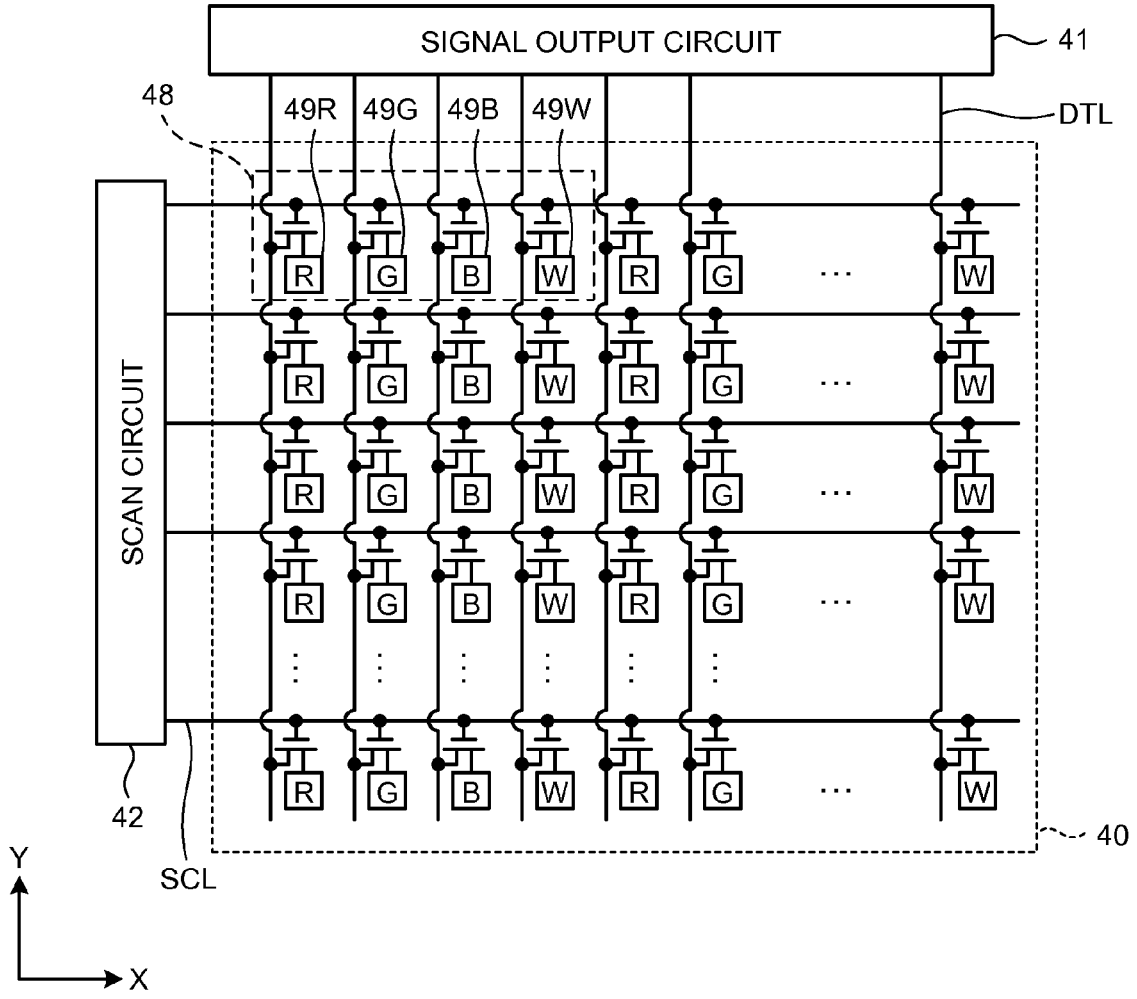
FIG. 3 is a conceptual diagram of the image display panel and an image display panel drive circuit of the display device according to the embodiment.
Figure 4:
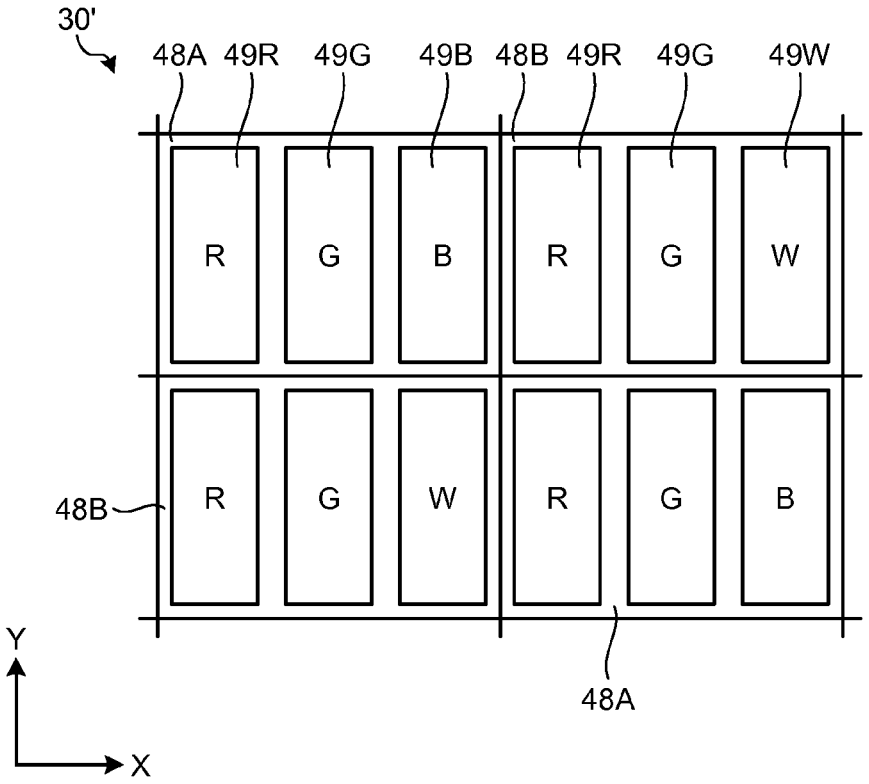
FIG. 4 is a diagram illustrating another example of the pixel array of the image display panel according to the embodiment.

FIG. 1 is a block diagram illustrating an example of a configuration of a display device according to the embodiment. FIG. 2 is a diagram illustrating a pixel array of an image display panel according to the embodiment. FIG. 3 is a conceptual diagram of the image display panel and an image display panel drive circuit of the display device according to the embodiment. FIG. 4 is a diagram illustrating another example of the pixel array of the image display panel according to the embodiment.

As illustrated in FIG. 1, the display device 10 includes a signal processing unit 20 that transmits signals to units of the display device 10 to control operations thereof, an image display panel 30 that displays an image based on output signals output from the signal processing unit 20, an image display panel drive circuit 40 that controls drive of the image display panel 30, a planar light source device 50 that illuminates the image display panel 30 from the back side, and a planar light source device control circuit 60 that controls drive of the planar light source device 50. The display device 10 has the same configuration as that of an image display device assembly described in Japanese Patent Application Laid-open Publication No. 2011-154323 (JP-A-2011-154323), and various modifications described in JP-A-2011-154323 are applicable thereto.

The signal processing unit 20 is a processing unit that controls the operations of the image display panel 30 and the planar light source device 50. The signal processing unit 20 is connected to the image display panel drive circuit 40 for driving the image display panel 30 and to the planar light source device control circuit 60 for driving the planar light source device 50. The signal processing unit 20 processes an externally supplied input signal, and generates output signals and a planar light source device control signal. In other words, the signal processing unit 20 generates the output signals by converting input values (input signals) in an input HSV color space of the input signal into extended values (output signals) in an extended HSV color space extended in four colors of a first color, a second color, a third color, and a fourth color, and outputs the generated output signals to the image display panel 30. The signal processing unit 20 outputs the generated output signals to the image display panel drive circuit 40 and outputs the generated planar light source device control signal to the planar light source device control circuit 60.

As illustrated in FIGS. 2 and 3, pixels 48 are arranged on the image display panel 30 in a two-dimensional matrix of $P_0 \times Q_0$ pixels ($P_0$ pixels in the row direction and $Q_0$ pixels in the column direction). The example illustrated in FIGS. 2 and 3 illustrates an example in which the pixels 48 are arranged in a matrix in a two-dimensional coordinate system of X and Y. In this example, the row direction corresponds to the X-direction, and the column direction corresponds to the Y-direction.

The pixels 48 include first sub-pixels 49R, second sub-pixels 49G, third sub-pixels 49B, and fourth sub-pixels 49W. The first sub-pixel 49R displays a first primary color (such as red). The second sub-pixel 49G displays a second primary color (such as green). The third sub-pixel 49B displays a third primary color (such as blue). The fourth sub-pixel 49W displays a fourth primary color (specifically, white). Hereinafter, the sub-pixel will be called a sub-pixel 49 when the first sub-pixel 49R, the second sub-pixel 49G, the third sub-pixel 49B, and the fourth sub-pixel 49W need not be distinguished from each other.

The display device 10 is more specifically a transmissive color liquid crystal display device. The image display panel 30 is a color liquid crystal display panel, in which a first color filter passing the first primary color is disposed between the first sub-pixel 49R and an image observer, and a second color filter passing the second primary color is disposed between the second sub-pixel 49G and the image observer, and a third color filter passing the third primary color is disposed between the third sub-pixel 49B and the image observer. The image display panel 30 has no color filter disposed between the fourth sub-pixel 49W and the image observer. The fourth sub-pixel 49W may be provided with a transparent resin layer instead of the color filter. Providing the fourth sub-pixel 49W with the transparent resin layer allows the image display panel 30 to keep a large step from occurring at the fourth sub-pixel 49W due to not providing the fourth sub-pixel 49W with the color filter.

In the example illustrated in FIG. 2, the first sub-pixels 49R, the second sub-pixels 49G, the third sub-pixels 49B, and the fourth sub-pixels 49W are arranged in an array similar to a stripe array on the image display panel 30. The structure and arrangement of the sub-pixels 49R, 49G, 49B, and 49W included in each one of the pixels 48 are not particularly limited. For example, on the image display panel 30, the first sub-pixels 49R, the second sub-pixels 49G, the third sub-pixels 49B, and the fourth sub-pixels 49W may be arranged in an array similar to a diagonal array (mosaic array), an array similar to a delta array (triangular array), or an array similar to a rectangular array. Furthermore, as illustrated as an image display panel 30' in FIG. 4, pixels 48A each including the first sub-pixels 49R, the second sub-pixels 49G, and the third sub-pixels 49B and pixels 48B each including the first sub-pixels 49R, the second sub-pixels 49G, and the fourth sub-pixels 49W may be alternately arranged in the row direction and in the column direction.

In general, the array similar to a stripe array is preferable for displaying data and strings on a personal computer or the like, whereas the array similar to a mosaic array is preferable for displaying natural images on a video camera recorder, a digital still camera, or the like.

The image display panel drive circuit 40 includes a signal output circuit 41 and a scan circuit 42. The image display panel drive circuit 40 uses the signal output circuit 41 to hold video signals and sequentially output them to the image display panel 30. The signal output circuit 41 is electrically connected to the image display panel 30 via wires DTL. The image display panel drive circuit 40 uses the scan circuit 42 to control on and off of switching elements (such as TFTs) for controlling operations (optical transmittance) of the sub-pixels on the image display panel 30. The scan circuit 42 is electrically connected to the image display panel 30 via wires SCL.

The planar light source device 50 is disposed on the back side of the image display panel 30, and projects light toward the image display panel 30 to illuminate the image display panel 30. The planar light source device 50 projects the light onto the whole surface of the image display panel 30 to make the image display panel 30 bright. The planar light source device control circuit 60 controls, for example, a light quantity of the light emitted from the planar light source device 50. Specifically, based on the planar light source device control signal output from the signal processing unit 20, the planar light source device control circuit 60 regulates a voltage or a duty ratio of power supply to the planar light source device 50 so as to control the light quantity of the light (intensity of the light) projected onto the image display panel 30. A description will next be made of a processing operation performed by the display device 10, more specifically, by the signal processing unit 20.

2. Processing Operation of Display Device

Figure 5:
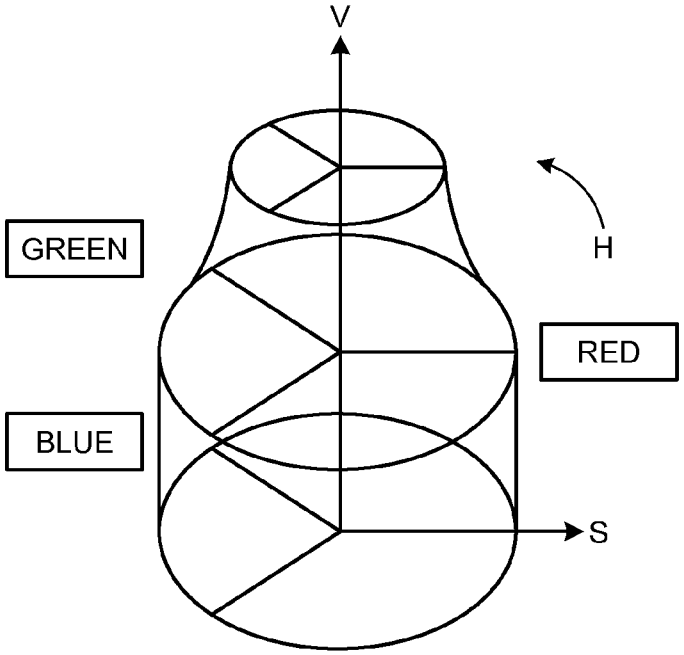
FIG. 5 is a conceptual diagram of an extended HSV color space that is extendable by the display device of the embodiment.
Figure 6:
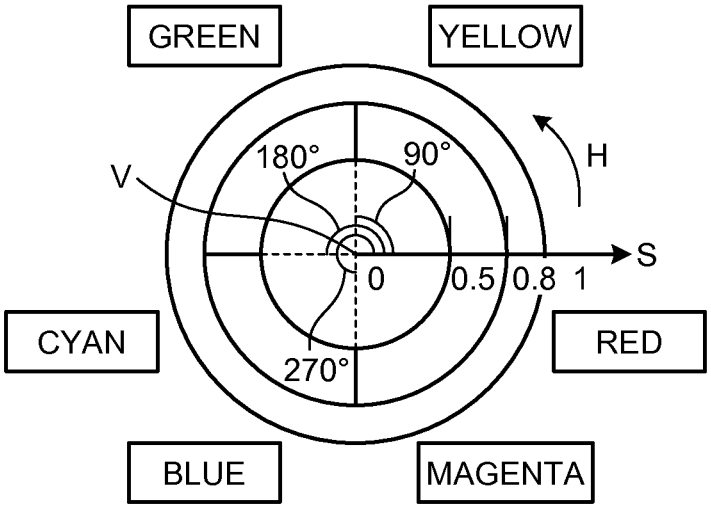
FIG. 6 is a conceptual diagram illustrating a relation between hue and saturation of the extended HSV color space.

FIG. 5 is a conceptual diagram of the extended HSV color space that is extendable by the display device of the embodiment. FIG. 6 is a conceptual diagram illustrating a relation between hue and saturation of the extended HSV color space. The signal processing unit 20 externally receives the input signal that is information on an image to be displayed. The input signal includes, as input signals, information on images (colors) to be displayed by respective pixels in positions thereof. Specifically, the signal processing unit 20 receives the signal that includes, with respect to the (p, q)th pixel 48 (where $1 \leq p \leq P_0$ and $1 \leq q \leq Q_0$) on the image display panel 30 on which the $P_0 \times Q_0$ pixels 48 are arranged in a matrix, an input signal for the first sub-pixel 49R having a signal value of $x_{1-(p,\ q)}$, an input signal for the second sub-pixel 49G having a signal value of $x_{2-(p,\ q)}$, and an input signal for the third sub-pixel 49B having a signal value of $x_{3-(p,\ q)}$ (refer to FIG. 1).

The signal processing unit 20 illustrated in FIG. 1 processes the input signal to generate an output signal (signal value $X_{1-(p,\ q)}$) for the first sub-pixel for determining the display gradation of the first sub-pixel 49R, an output signal (signal value $X_{2-(p,\ q)}$) for the second sub-pixel for determining the display gradation of the second sub-pixel 49G, an output signal (signal value $X_{3-(p,\ q)}$) for the third sub-pixel for determining the display gradation of the third sub-pixel 49B, and an output signal (signal value $X_{4-(p,\ q)}$) for the fourth sub-pixel for determining the display gradation of the fourth sub-pixel 49W, and outputs the generated output signals to the image display panel drive circuit 40.

By including the fourth sub-pixel 49W that outputs the fourth color (white) to the pixel 48, the display device 10 can increase a dynamic range of brightness in the HSV color space (extended HSV color space), as illustrated in FIG. 5. In other words, as illustrated in FIG. 5, the extended HSV color space has a shape obtained by placing a sold having a substantially trapezoidal body shape in which the maximum value of brightness V is lower as a saturation S is higher on a cylindrical HSV color space in which the first sub-pixel 49R, the second sub-pixel 49G, and the third sub-pixel 49B can perform display.

The signal processing unit 20 stores maximum values Vmax(S) of brightness with the saturation S serving as a variable in the HSV color space expanded by the addition of the fourth color (white). In other words, with respect to the solid shape of the HSV color space illustrated in FIG. 5, the signal processing unit 20 stores each value of the maximum values Vmax(S) of brightness for each pair of coordinates (values) of the saturation and the hue. Because the input signal includes the input signals for the first sub-pixel 49R, the second sub-pixel 49G, and the third sub-pixel 49B, the HSV color space of the input signal has a cylindrical shape, that is, the same shape as the cylindrical part of the extended HSV color space.

Based on at least the input signal (signal value $x_{1-(p,\ q)}$) for the first sub-pixel 49R and an extension coefficient $\alpha$, the signal processing unit 20 calculates the output signal (signal value $X_{1-(p,\ q)}$) for the first sub-pixel 49R, and outputs the calculated output signal to the first sub-pixel 49R. Based on at least the input signal (signal value $x_{2-(p,\ q)}$) for the second sub-pixel 49G and the extension coefficient $\alpha$, the signal processing unit 20 calculates the output signal (signal value $X_{2-(p,\ q)}$) for the second sub-pixel 49G, and outputs the calculated output signal to the second sub-pixel 49G. Based on at least the input signal (signal value $x_{3-(p,\ q)}$) for the third sub-pixel 49B and the extension coefficient $\alpha$, the signal processing unit 20 calculates the output signal (signal value $X_{3-(p,\ q)}$) for the third sub-pixel 49B, and outputs the calculated output signal to the third sub-pixel 49B. Based on at least the input signal (signal value $x_{1-(p,\ q)}$) for the first sub-pixel 49R, the input signal (signal value $x_{2-(p,q)}$) for the second sub-pixel 49G, and the input signal (signal value $x_{3-(p,q)}$) for the third sub-pixel 49B, the signal processing unit 20 calculates the output signal (signal value $X_{4-(p,q)}$) for the fourth sub-pixel 49W, and outputs the calculated output signal to the fourth sub-pixel 49W.

Specifically, the signal processing unit 20 calculates the output signal for the first sub-pixel 49R based on the input signal (signal value $x_{1-(p,q)}$) for the first sub-pixel 49R, the extension coefficient α, and the output signal for the fourth sub-pixel 49W, calculates the output signal for the second sub-pixel 49G based on the input signal (signal value $x_{2-(p,q)}$) for the second sub-pixel 49G, the extension coefficient α, and the output signal for the fourth sub-pixel 49W, and calculates the output signal for the third sub-pixel 49B based on the input signal (signal value $x_{3-(p,q)}$) for the third sub-pixel 49B, the extension coefficient α, and the output signal for the fourth sub-pixel 49W.

In other words, assuming χ as a constant depending on the display device, the signal processing unit 20 uses Equations (1) to (3) given below to obtain the signal value $X_{1-(p,q)}$ serving as the output signal for the first sub-pixel 49R, the signal value $X_{2-(p,q)}$ serving as the output signal for the second sub-pixel 49G, and the signal value $X_{3-(p,q)}$ serving as the output signal for the third sub-pixel 49B, the output signals being to be output to the (p, q)th pixel (or, the (p, q)th set of the first sub-pixel 49R, the second sub-pixel 49G, and the third sub-pixel 49B).

$$X_{1-(p,q)}=\alpha\cdot x_{1-(p,q)}-\chi\cdot X_{4-(p,q)} \quad (1)$$

$$X_{2-(p,q)}=\alpha\cdot x_{2-(p,q)}-\chi\cdot X_{4-(p,q)} \quad (2)$$

$$X_{3-(p,q)}=\alpha\cdot x_{3-(p,q)}-\chi\cdot X_{4-(p,q)} \quad (3)$$

The signal processing unit 20 obtains the maximum value Vmax(S) of brightness with the saturation S serving as a variable in the HSV color space expanded by the addition of the fourth color, and based on the input signal values for the sub-pixels 49 in the pixels 48, obtains the saturation values S and the brightness values V(S) in the pixels 48.

The saturation S and the brightness V(S) are expressed as S=(Max−Min)/Max and V(S)=Max, respectively. The saturation S can have a value from 0 to 1, and the brightness V(S) can have a value from 0 to $(2^n-1)$. The exponent n is the number of display gradation bits. Max is the maximum of the input signal value for the first sub-pixel 49R, the input signal value for the second sub-pixel 49G, and the input signal value for the third sub-pixel 49B, the input signal values being supplied to the pixels 48. Min is the minimum of the input signal value for the first sub-pixel 49R, the input signal value for the second sub-pixel 49G, and the input signal value for the third sub-pixel 49B, the input signal values being supplied to the pixels 48. A hue H is expressed by a value from 0 degrees to 360 degrees, as illustrated in FIG. 6. The hue H changes from 0 degrees toward 360 degrees as red, yellow, green, cyan, blue, magenta, and then red.

In the embodiment, the signal value $X_{4-(p,q)}$ can be obtained based on the product of $Min_{(p,q)}$ and the extension coefficient α. Specifically, the signal value $X_{4-(p,q)}$ can be obtained based on Equation (4) given below. While Equation (4) divides the product of $Min_{(p,q)}$ and the extension coefficient α by χ, the equation is not limited to this. The constant χ will be described later. The extension coefficient α is determined for each image display frame.

$$X_{4-(p,q)}=Min_{(p,q)}\cdot\alpha/\chi \quad (4)$$

In general, in the (p, q)th pixel, Equations (5) and (6) below can be used to obtain the saturation $S_{(p,q)}$ and the brightness $V(S)_{(p,q)}$ in the cylindrical HSV color space, based on the input signal (signal value $x_{1-(p,q)}$) for the first sub-pixel 49R, the input signal (signal value $x_{2-(p,q)}$) for the second sub-pixel 49G, and the input signal (signal value $x_{3-(p,q)}$) for the third sub-pixel 49B.

$$S_{(p,q)}=(Max_{(p,q)}-Min_{(p,q)})/Max_{(p,q)} \quad (5)$$

$$V(S)_{(p,q)}=Max_{(p,q)} \quad (6)$$

$Max_{(p,q)}$ is the maximum value of the input signal values ($x_{1-(p,q)}$, $x_{2-(p,q)}$, and $x_{3-(p,q)}$) for the three sub-pixels 49. $Min_{(p,q)}$ is the minimum value of the input signal values ($x_{1-(p,q)}$, $x_{2-(p,q)}$, and $x_{3-(p,q)}$) for the three sub-pixels 49. The embodiment assumes that n=8. In other words, the number of display gradation bits is assumed to be eight (the display gradation having a value in 256 levels of gradation from 0 to 255).

The fourth sub-pixel 49W displays white color, and thus is not provided with a color filter. Suppose that the first sub-pixel 49R is supplied with a signal having a value equivalent to the maximum signal value of the output signal for the first sub-pixel, that the second sub-pixel 49G is supplied with a signal having a value equivalent to the maximum signal value of the output signal for the second sub-pixel, and that the third sub-pixel 49B is supplied with a signal having a value equivalent to the maximum signal value of the output signal for the third sub-pixel. In that case, a collective set of the first sub-pixel 49R, the second sub-pixel 49G, and the third sub-pixel 49B included in the pixel 48 or a group of the pixels 48 is assumed to have a luminance value of $BN_{1-3}$. Suppose also that the fourth sub-pixel 49W included in the pixel 48 or a group of the pixels 48 is supplied with a signal having a value equivalent to the maximum signal value of the output signal for the fourth sub-pixel 49W. In that case, the fourth sub-pixel 49W is assumed to have a luminance value of $BN_4$. In other words, the collective set of the first sub-pixel 49R, the second sub-pixel 49G, and the third sub-pixel 49B displays white color having a maximum luminance value, and the luminance of the white color is represented by $BN_{1-3}$. Then, assuming χ as a constant depending on the display device, the constant χ is expressed as $\chi=BN_4/BN_{1-3}$.

Specifically, suppose that the luminance $BN_{1-3}$ of the white color is obtained when the collective set of the first sub-pixel 49R, the second sub-pixel 49G, and the third sub-pixel 49B is supplied with the input signals having the following values of the display gradation, that is, the signal value $x_{1-(p,q)}=255$, the signal value $x_{2-(p,q)}=255$, and the signal value $x_{3-(p,q)}=255$. Suppose also that the luminance $BN_4$ is obtained when the fourth sub-pixel 49W is supplied with the input signal having a value 255 of the display gradation. Then, the luminance $BN_4$ has a value, for example, 1.5 times as large as the luminance $BN_{1-3}$. In other words, χ=1.5 in the embodiment.

When the signal value $X_{4-(p,q)}$ is given by Equation (4) above, Vmax(S) can be expressed by Equations (7) and (8) given below.

When $S\leq S_0$, $$Vmax(S)=(\chi+1)\cdot(2^n-1) \quad (7)$$

When $S_0<S\leq 1$, $$Vmax(S)=(2^n-1)\cdot(1/S) \quad (8)$$

where $S_0=1/(\chi+1)$.

The signal processing unit 20 stores, for example, as a kind of look-up table, the thus obtained maximum values Vmax(S) of brightness with the saturation S serving as a variable in the HSV color space expanded by the addition of the fourth color. Otherwise, the signal processing unit 20 obtains the maximum values Vmax(S) of brightness with the saturation S serving as a variable in the expanded HSV color space, on a case-by-case basis.

A description will next be made of a method (extension process) of obtaining the signal values $X_{1-(p,\ q)}$, $X_{2-(p,\ q)}$, $X_{3-(p,\ q)}$, and $X_{4-(p,\ q)}$ serving as the output signals in the (p, q)th pixel 48. The following process is performed so as to keep a ratio among the luminance of the first primary color displayed by the (first sub-pixel 49R+fourth sub-pixel 49W), the luminance of the second primary color displayed by the (second sub-pixel 49G+fourth sub-pixel 49W), and the luminance of the third primary color displayed by the (third sub-pixel 49B+fourth sub-pixel 49W). The following process is performed so as to also keep (maintain) a color tone. The following process is performed so as to also keep (maintain) gradation-luminance characteristics (gamma characteristic, or γ characteristics). When all of the input signal values are zero or small in any of the pixels 48 or any group of the pixels 48, the extension coefficient α can be obtained without including such a pixel 48 or such a group of the pixels 48.

First Step

First, based on the input signal values for the sub-pixels 49 in the pixels 48, the signal processing unit 20 obtains the saturation S and the brightness V(S) in the pixels 48. Specifically, based on the signal value $x_{1-(p,\ q)}$ serving as the input signal for the first sub-pixel 49R, the signal value $x_{2-(p,\ q)}$ serving as the input signal for the second sub-pixel 49G, and the signal value $x_{3-(p,\ q)}$ serving as the input signal for the third sub-pixel 49B input into the (p, q)th pixel 48, the signal processing unit 20 obtains $S_{(p,\ q)}$ and $V(S)_{(p,\ q)}$ from Equations (5) and (6). The signal processing unit 20 applies this process to all of the pixels 48.

Second Step

The signal processing unit 20 subsequently obtains the extension coefficient α(S) from Equation (9) given below, based on Vmax(S)/V(S) obtained in the pixels 48.

$$\alpha(S)=V\max(S)/V(S) \tag{9}$$

Third Step

Next, based on at least the signal values $x_{1-(p,\ q)}$, $x_{2-(p,\ q)}$, and $x_{3-(p,\ q)}$ of the input signals, the signal processing unit 20 obtains the signal value $X_{4-(p,\ q)}$ in the (p, q)th pixel 48. In the embodiment, the signal processing unit 20 determines the signal value $X_{4-(p,\ q)}$ based on $Min_{(p,\ q)}$, the extension coefficient α, and the constant χ. More specifically, the signal processing unit 20 obtains the signal value $X_{4-(p,\ q)}$ based on Equation (4) given above, as described above. The signal processing unit 20 obtains the signal values $X_{4-(p,\ q)}$ in all of the $P_0 \times Q_0$ pixels 48.

Fourth Step

Thereafter, the signal processing unit 20 obtains the signal value $X_{1-(p,\ q)}$ in the (p, q)th pixel 48 based on the signal value $x_{1-(p,\ q)}$, the extension coefficient α, and the signal value $X_{4-(p,\ q)}$, obtains the signal value $X_{2-(p,\ q)}$ in the (p, q)th pixel 48 based on the signal value $x_{2-(p,\ q)}$, the extension coefficient α, and the signal value $X_{4-(p,\ q)}$, and obtains the signal value $X_{3-(p,\ q)}$ in the (p, q)th pixel 48 based on the signal value $x_{3-(p,\ q)}$, the extension coefficient α, and the signal value $X_{4-(p,\ q)}$. Specifically, the signal processing unit 20 obtains the signal values $X_{1-(p,q)}$, $X_{2-(p,q)}$, and $X_{3-(p,q)}$ in the (p, q)th pixel 48 based on Equations (1) to (3) given above.

As indicated by Equation (4), the signal processing unit 20 extends the value of $Min_{(p,\ q)}$ according to α. In this manner, the extension of $Min_{(p,\ q)}$ according to α increases the luminance of the white display sub-pixel (fourth sub-pixel 49W), and also increases the luminance of the red display sub-pixel, the green display sub-pixel, and the blue display sub-pixel (corresponding to the first sub-pixel 49R, the second sub-pixel 49G, and the third sub-pixel 49B, respectively) as indicated by Equations given above. This can avoid a problem of occurrence of dulling of colors. Specifically, the extension of the value of $Min_{(p,\ q)}$ according to α increases the luminance of an entire image by a factor of α compared with a case in which the value of $Min_{(p,\ q)}$ is not extended. This allows, for example, a still image to be displayed at high luminance, thus being desirable.

The luminance of display given by the output signals $X_{1-(p,\ q)}$, $X_{2-(p,\ q)}$, $X_{3-(p,\ q)}$, and $X_{4-(p,\ q)}$ in the (p, q)th pixel 48 is extended to α times as much as the luminance formed from the input signals $x_{1-(p,\ q)}$, $x_{2-(p,\ q)}$, and $x_{3-(p,\ q)}$. This only requires the display device 10 to reduce the luminance of the planar light source device 50 based on the extension coefficient α in order to give a pixel 48 the same luminance as that of a pixel 48 with the signal values not extended. Specifically, the luminance of the planar light source device 50 only needs to be reduced by a factor of (1/α).

3. Setting of Extension Coefficient

To improve visibility of the display device 10 in outdoors, there is a known technique that the extension coefficient α for extending the signals is changed according to the brightness V of the input signals. For example, the extension coefficient α is set larger on the side where V is small, that is, on the low-gradation side, and is set smaller on the side where V is large, that is, on the high-gradation side. This results in increasing the luminance on the low-gradation side, thus improving the visibility of the display device 10 in outdoors.

Figure 7:
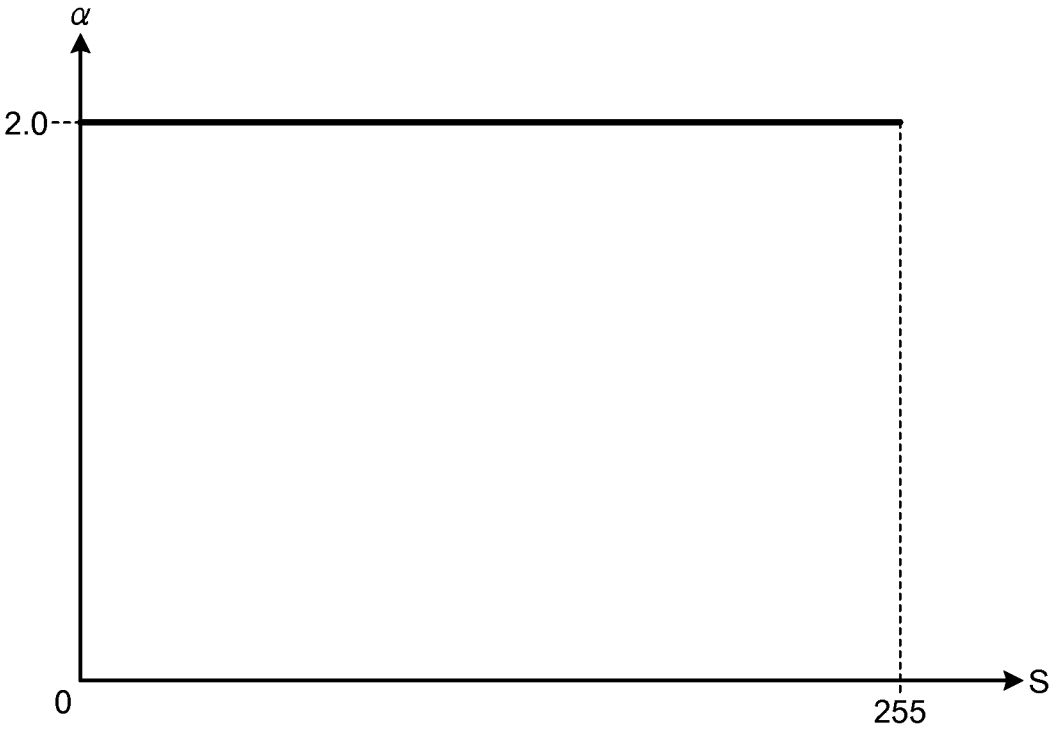
FIG. 7 is a diagram illustrating an example in which an extension coefficient is always constant and does not change with change in the saturation.
Figure 8:
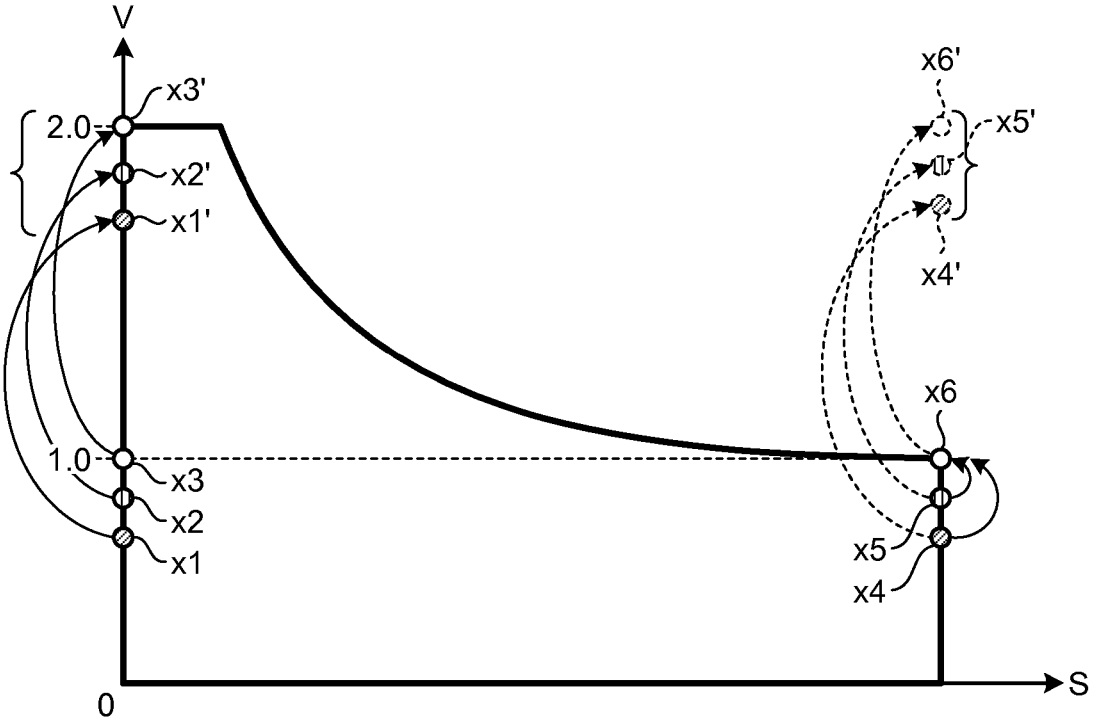
FIG. 8 is a diagram illustrating an HSV color space.
Figure 9:
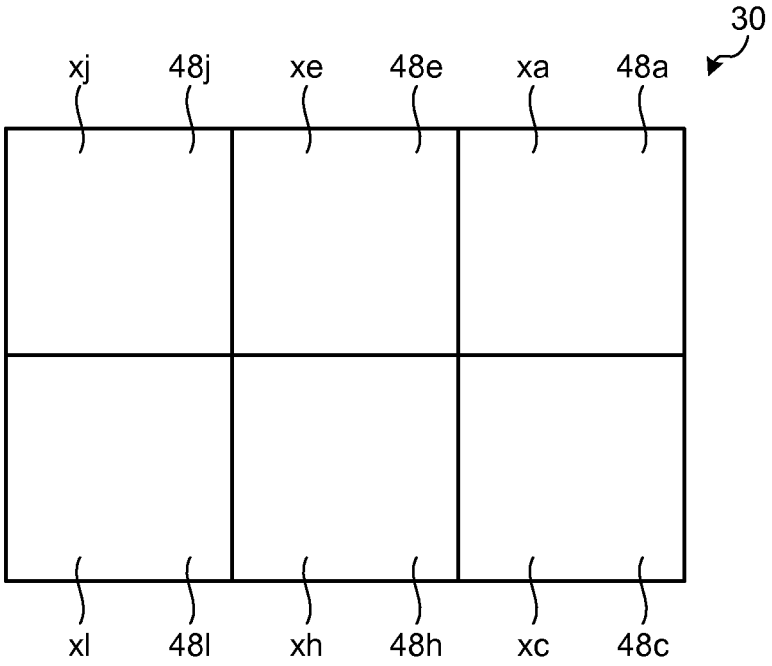
FIG. 9 is a diagram for explaining input values to respective pixels.
Figure 10:
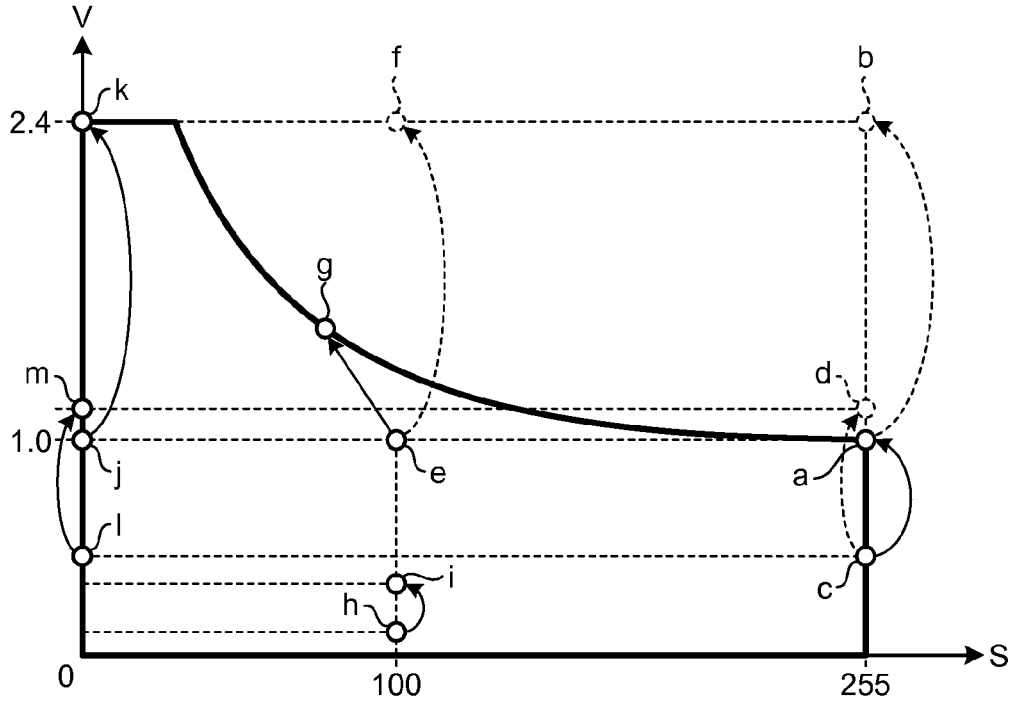
FIG. 10 is a diagram illustrating, in the HSV color space, input signal values before and after being extended by the extension coefficient.

3-1. In Case of Always Constant Extension Coefficient α with Respect to Saturation S FIG. 7 is a diagram illustrating an example in which the extension coefficient is always constant and does not change with change in the saturation. FIG. 8 is a diagram illustrating the HSV color space. FIG. 9 is a diagram for explaining the input values to the respective pixels. FIG. 10 is a diagram illustrating, in the HSV color space, the input signal values before and after being extended by the extension coefficient.

A case will be studied in which the extension coefficient α is always constant with respect to the saturation S as illustrated in FIG. 7. This study considers an HSV color space such as that illustrated in FIG. 8 in the case in which the fourth sub-pixel 49W is added as the white display sub-pixel, and considers a case in which the extension coefficient is 2.0 for the signal values giving V=0.8 or more. While the HSV color space is normally a three-dimensional solid color space such as that illustrated in FIG. 5 mentioned above because of including the hue H, the HSV color space in this study is a two-dimensional color space expressed by an orthogonal coordinate system of the saturation S and the brightness V, as illustrated in FIG. 8, because this study does not take the hue H into consideration.

When this study assumes the signal values (gradation values)×serving as the input signals to be (Rin, Gin, Bin), the saturation S is represented by Equation (10) and the brightness V is represented by Equation (11). As described above, min(Rin, Gin, Bin) represents the minimum of the signal values x(Rin, Gin, Bin), that is, Min mentioned above. Also, max(Rin, Gin, Bin) represents the maximum of the signal values x(Rin, Gin, Bin), that is, Max mentioned above.

$$S=255\cdot(1-\min(Rin,Gin,Bin)/\max(Rin,Gin,Bin)) \tag{10}$$

$$V=(\max(Rin,Gin,Bin)/255)^{2.2} \tag{11}$$

As described above, the saturation S is a function of max and min of the signal values x. The brightness V is not the value of max of the signal values (gradation values) of the input, but a value obtained by converting the value of max into linearized and normalized luminance information. The saturation S and the brightness V are not limited to these values.

As illustrated in FIG. 7, the extension coefficient α is 2 regardless of the level of the saturation S. Thus, for example, as illustrated in FIG. 8, when the saturation S is 0, a signal value x1 having the brightness V=0.8, a signal value x2 having the brightness V=0.9, and a signal value x3 having the brightness V=1.0 are extended to x1', x2', and x3' that give values of the brightness V=1.6, the brightness V=1.8, and the brightness V=2.0, respectively, after the extension. In this case, as illustrated in FIG. 8, all of the values x1', x2', and x3' after the extension reside in the color space, thus causing no problem and improving the luminance.

In the case of signals having the saturation S of 255, a signal value X4 for having brightness V=0.8, a signal value X5 having the brightness V=0.9, and a signal value having for the brightness V=1.0 are supposed to be extended to x4', x5', and x6' that give values of the brightness V=1.6, the brightness V=1.8, and the brightness V=2.0, respectively, after the extension. However, the maximum value of the color space is 1 when the saturation S=255, so that the values of x4', x5', and x6' after the extension are all clipped to the brightness V=1.0, as illustrated in FIG. 8. This means that the gradation information of the input signals giving the brightness V=1.6, the brightness V=1.8, and the brightness V=2.0 is partially lost, and thus, gradation collapse occurs. In this way, when the extension coefficient α is constant regardless of the saturation S, the luminance is significantly improved but significant display quality deterioration is likely to occur on the high-saturation side where the color space is smaller. A more specific description will next be made.

FIG. 9 illustrates that signal values xa, xc, xe, xh, xj, and xl are supplied to a plurality of pixels 48*a*, 48*c*, 48*e*, 48*h*, 48*j*, and 48*l*, respectively, included in the image display panel 30. An example will be described in which the signal values xa, xc, xe, xh, xj, and xl are supplied to the pixels 48*a*, 48*c*, 48*e*, 48*h*, 48*j*, and 48*l*, respectively, when the extension coefficient α is 2.4 regardless of change in the saturation S. The value of γ of the image display panel 30 is 2.2, and the number of gradations thereof is 8 bits, that is, 256.

When Equation (11) is used to linearize the signal value xa(R, G, B)=(255, 255, 0) that is an input signal giving the saturation S=255, the signal value xa is converted into $((255/255)^{2.2}, (255/255)^{2.2}, (0/255)^{2.2})$ (1, 1, 0). Thus, the signal value xa in the HSV color space is represented by Point a in FIG. 10. Multiplying the signal value xa after the linearization by the extension coefficient α=2.4 is supposed to give a value (2.4, 2.4, 0) after the extension at Point b in FIG. 10. However, because the maximum value of the HSV color space is 1 when the saturation S=255, the value after the extension does not exceed that value, but remains (1, 1, 0), that is, does not change from Point a in FIG. 10.

When Equation (11) is used to linearize the signal value xc(R, G, B)=(180, 180, 0) that is an input signal giving the saturation S=255, the signal value xc is converted into $((180/255)2.2, (180/255)^{2.2}, (0/255)^{2.2})$=(0.46, 0.46, 0). Thus, the signal value xc in the HSV color space is represented by Point c in FIG. 10. Multiplying the signal value xc after the linearization by the extension coefficient α=2.4 is supposed to give a value (1.1, 1.1, 0) after the extension at Point d in FIG. 10. However, because the maximum value of the HSV color space is 1 when the saturation S=255, the value after the extension does not exceed that value, but remains (1, 1, 0), that is, remains at Point a in FIG. 10. In this way, extending an image with the signal value xa(255, 255, 0) or the signal value xc(180, 180, 0) by a factor of the extension coefficient α=2.4 gives the signal value (255, 255, 0), so that the gradation collapse occurs.

When Equation (11) is used to linearize the signal value xe(R, G, B)=(255, 220, 155) that is an input signal giving the saturation S=100, the signal value xe is converted into (1.0, 0.72, 0.33). Thus, the signal value xe in the HSV color space is represented by Point e in FIG. 10. Multiplying the signal value xe after the linearization by the extension coefficient α=2.4 does not give a value after the extension outside the HSV color space (at Point f in FIG. 10), but gives a value (1.624, 1.624, 0.83) at Point g in the HSV color space. In other words, the luminance ratio of R:G:B at the signal value (1.0, 0.72, 0.33) obtained by linearizing the signal value xe of the input differs from the luminance ratio of R:G:B of the output value obtained by the multiplication by the extension coefficient α=2.4. This causes a change in color.

When Equation (11) is used to linearize the signal value xh(R, G, B)=(102, 80, 62) that is an input signal giving the saturation S=100, the signal value xh is converted into (0.13, 0.08, 0.045). Thus, the signal value xh in the HSV color space is represented by Point h in FIG. 10. Multiplying the signal value xh after the linearization by the extension coefficient α=2.4 gives a value (0.32, 0.19, 0.11) after the extension. This value remains in the HSV color space (at Point i in FIG. 10), so that the luminance ratio of R:G:B of the input does not differ from the luminance ratio of R:G:B of the output value obtained by the multiplication by the extension coefficient α=2.4, and thus the display quality deterioration does not occur.

When Equation (11) is used to linearize the signal value xj(R, G, B)=(255, 255, 255) that is an input signal giving the saturation S=0, the signal value xj is converted into (1, 1, 1). Thus, the signal value xj in the HSV color space is represented by Point j in FIG. 10. Multiplying the signal value xj after the linearization by the extension coefficient α=2.4 gives a value (2.4, 2.4, 2.4) after the extension. This value remains in the HSV color space (at Point k in FIG. 10), so that the luminance ratio of R:G:B of the input does not differ from the luminance ratio of R:G:B of the output value obtained by the multiplication by the extension coefficient α=2.4, and thus the display quality deterioration does not occur.

When Equation (11) is used to linearize the signal value xl(R, G, B)=(180, 180, 180) that is an input signal giving the saturation S=0, the signal value xl is converted into (0.46, 0.46, 0.46). Thus, the signal value xl in the HSV color space is represented by Point 1 in FIG. 10. Multiplying the signal value xl after the linearization by the extension coefficient α=2.4 gives a value (1.1, 1.1, 1.1) after the extension. This value remains in the HSV color space (at Point m in FIG. 10), so that the luminance ratio of R:G:B of the input does not differ from the luminance ratio of R:G:B of the output value obtained by the multiplication by the extension coefficient α=2.4, and thus the display quality deterioration does not occur. That is, multiplying the signal values xj and xl having S=0 by the extension coefficient α (2.4 in the present example) keeps the values after the extension always in the HSV color space, so that the display quality deterioration, such as the gradation collapse and the change in color, does not occur.

As described above, it is found that multiplying a signal value having the saturation S by a certain extension coefficient α may cause the display quality deterioration, such as the gradation collapse and the change in color. The above-described example also indicates that increasing the extension coefficient α multiplying the signal values xa, xc, xe, xh, xj, and xl serving as the input signals increases the display quality deterioration.

3-2. Extension Coefficient According to Present Embodiment

Figure 11:
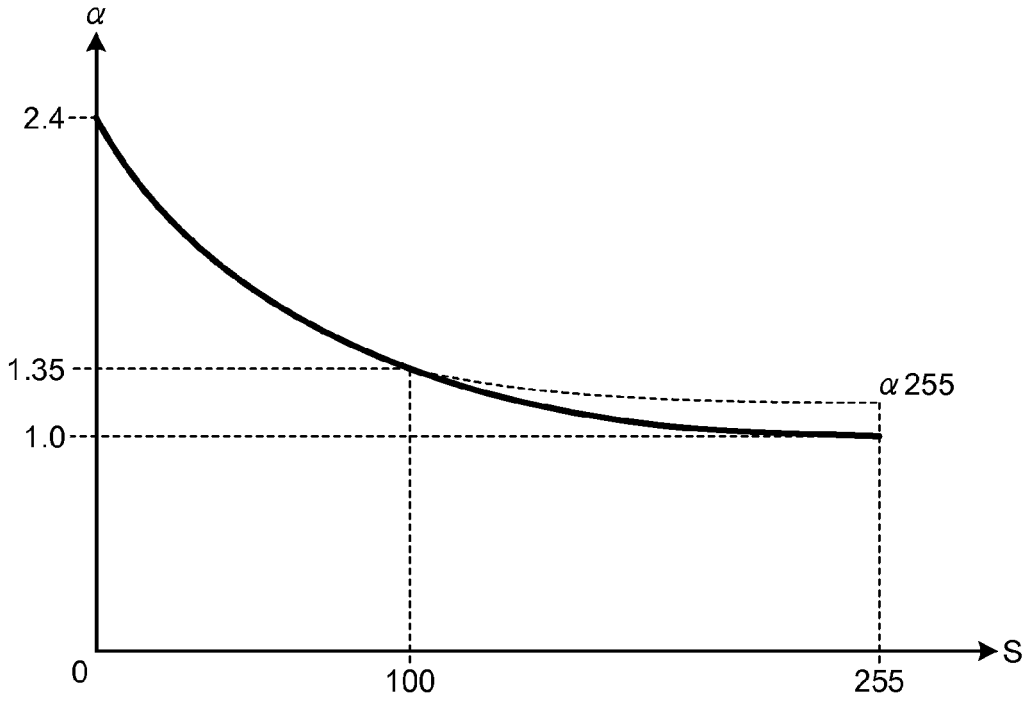
FIG. 11 is a diagram illustrating an example in which the extension coefficient changes with change in the saturation.
Figure 12:
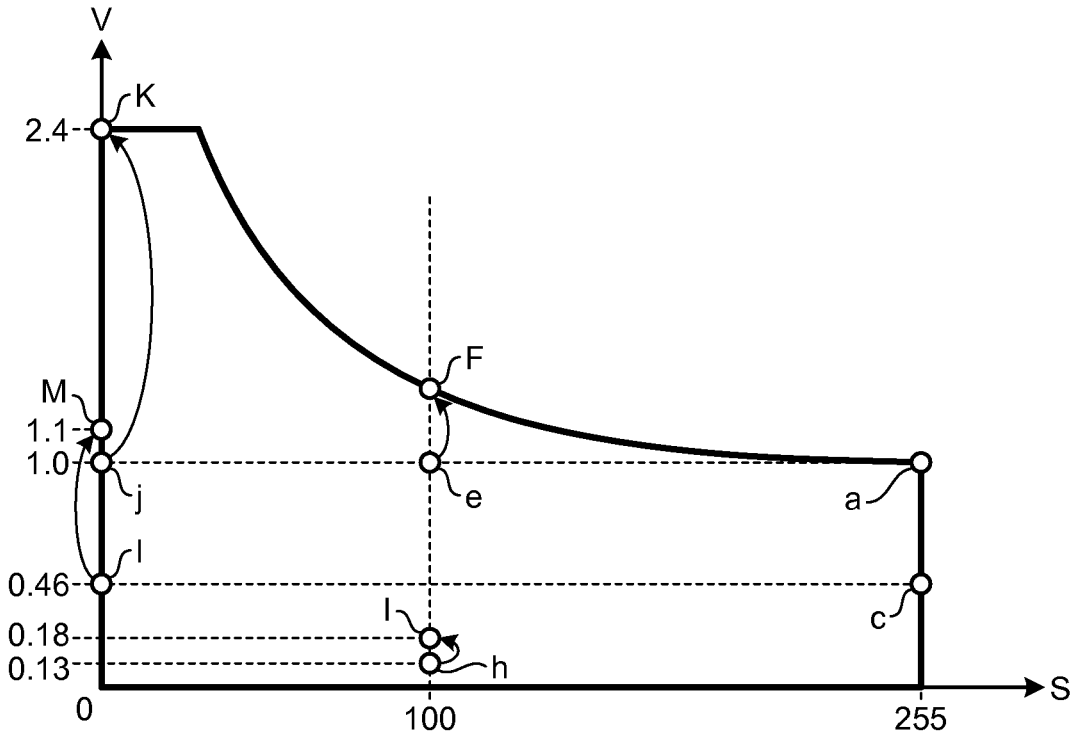
FIG. 12 is a diagram illustrating the HSV color space.

FIG. 11 is a diagram illustrating an example in which the extension coefficient changes with change in the saturation. FIG. 12 is a diagram illustrating the HSV color space. A driving method of the display device according to the embodiment changes the extension coefficient α based on the saturation S of the input signal as illustrated in FIG. 11. As a result, the extension coefficient α varies based on the saturation S of the input signal. As illustrated in FIG. 11, this example gives a smaller extension coefficient α for the signal value giving a larger saturation S, and a larger extension coefficient α for the signal value giving a smaller saturation S. In other words, the extension coefficient α decreases as the saturation S increases.

When Equation (11) is used to linearize the signal value xa(R, G, B)=(255, 255, 0) serving as the input signal giving the saturation S=255, the signal value xa is converted into (1, 1, 0). Thus, the signal value xa in the HSV color space is represented by Point a in FIG. 12. As illustrated in FIG. 11, the extension coefficient α is 1.0 when the saturation S=255. Therefore, multiplying the signal value xa after the linearization by the extension coefficient α=1.0 gives a value (1, 1, 0) after the extension, which is the same as that before the extension, that is, which does not differ from the input value. As a result, the gradation collapse does not occur.

When the signal value xc(R, G, B)=(180, 180, 0) serving as the input signal giving the saturation S=255 is converted into a linearized signal value (0.46, 0.46, 0), the signal value xc in the HSV color space is represented by Point c in FIG. 12. Multiplying the signal value xc after the linearization by the extension coefficient α=1.0 gives a value (0.46, 0.46, 0) after the extension, which is the same as that before the extension, that is, which does not differ from the input value. As a result, the gradation collapse does not occur.

When the signal value xe(R, G, B)=(255, 220, 155) serving as the input signal giving the saturation S=100 is converted into a linearized signal value (1.0, 0.72, 0.33), the signal value xe in the HSV color space is represented by Point e in FIG. 12. As illustrated in FIG. 11, the extension coefficient α is 1.35 when the saturation S=100. Therefore, multiplying the signal value xe after the linearization by the extension coefficient α=1.35 gives a value (1.35, 0.977, 0.452) after the extension. This value is a value at Point F in FIG. 12. Point F resides in the HSV color space, so that the display quality deterioration, such as the change in color, does not occur.

When the signal value xh(R, G, B)=(102, 80, 62) serving as the input signal giving the saturation S=100 is converted into a linearized signal value (0.13, 0.08, 0.045), the signal value xh in the HSV color space is represented by Point h in FIG. 12. Multiplying the signal value xh after the linearization by the extension coefficient α=1.35 gives a value (0.18, 0.11, 0.06) after the extension. This value remains in the HSV color space (at Point I in FIG. 12), so that the luminance ratio of R:G:B of the input does not differ from the luminance ratio of R:G:B of the output value obtained by the multiplication by the extension coefficient α=1.35, and Point I resides in the HSV color space. Thus, the display quality deterioration does not occur.

When the signal value xj(R, G, B)=(255, 255, 255) serving as the input signal giving the saturation S=0 is converted into a linearized signal value (1, 1, 1), the signal value xj in the HSV color space is represented by Point j in FIG. 12. As illustrated in FIG. 11, the extension coefficient α is 2.4 when the saturation S=0. Therefore, multiplying the signal value xj after the linearization by the extension coefficient α=2.4 gives a value (2.4, 2.4, 2.4) after the extension. This value remains in the HSV color space (at Point K in FIG. 12), so that the luminance ratio of R:G:B of the input does not differ from the luminance ratio of R:G:B of the output value obtained by the multiplication by the extension coefficient α=2.4, and Point K resides in the HSV color space. Thus, the display quality deterioration does not occur.

When the signal value xl(R, G, B)=(180, 180, 180) serving as the input signal giving the saturation S=0 is converted into a linearized signal value (0.46, 0.46, 0.46), the signal value xl in the HSV color space is represented by Point 1 in FIG. 12. Multiplying the signal value xl after the linearization by the extension coefficient α=2.4 gives a value (1.1, 1.1, 1.1) after the extension. This value remains in the HSV color space (at Point M in FIG. 12), so that the luminance ratio of R:G:B of the input does not differ from the luminance ratio of R:G:B of the output value obtained by the multiplication by the extension coefficient α=2.4, and Point M resides in the HSV color space. Thus, the display quality deterioration does not occur. That is, multiplying the signal values xj and xl having S=0 by the extension coefficient α (2.4 in the present example) keeps the values after the extension always in the HSV color space, so that the display quality deterioration, such as the gradation collapse and the change in color, does not occur.

As described above, the display device 10 and the driving method thereof in the embodiment can improve the luminance while suppressing the display quality deterioration, by changing the extension coefficient α based on the function of max and min of the input signal, specifically, the saturation S defined by Equation (10) in the embodiment. Not only Equation (10) but also Equation (12) given below for example can be used to obtain the saturation of the signal value.

$$S=\max(R\text{in},G\text{in},B\text{in})-\min(R\text{in},G\text{in},B\text{in}) \quad (12)$$

Equation (12) represents a subtraction operation between max(Rin, Gin, Bin) and min(Rin, Gin, Bin). In other words, the equation does not include a division operation which complicates arithmetic processing. Therefore, using the saturation S obtained by Equation (12) can simplify the arithmetic processing, and thus can reduce a load to hardware. Using Equation (12) can also reduce a scale of an operational circuit.

While the above-described example assumes the extension coefficient α to be 1.0 when the saturation S=255, the extension coefficient α is not limited to this value. This is because, when the saturation S is large (for example, S=127 or more), the display quality hardly deteriorates even if the signal value after the extension departs from the HSV color space to some degree. This allows an extension coefficient α255 when the saturation S=255 to be set larger than 1.0, as illustrated in FIG. 11. While the extension coefficient α=2.4 when the saturation S=0, the extension coefficient α is not limited to this value, but an appropriate value can be used depending on the type or specifications of the display device 10, more specifically, the image display panel 30, illustrated in FIG. 1. An appropriate way of changing the extension coefficient α corresponding to the saturation S can be used depending on the image display panel 30. For example, the extension coefficient α can be changed along the shape of the HSV color space illustrated in FIG. 12.

Figure 13:
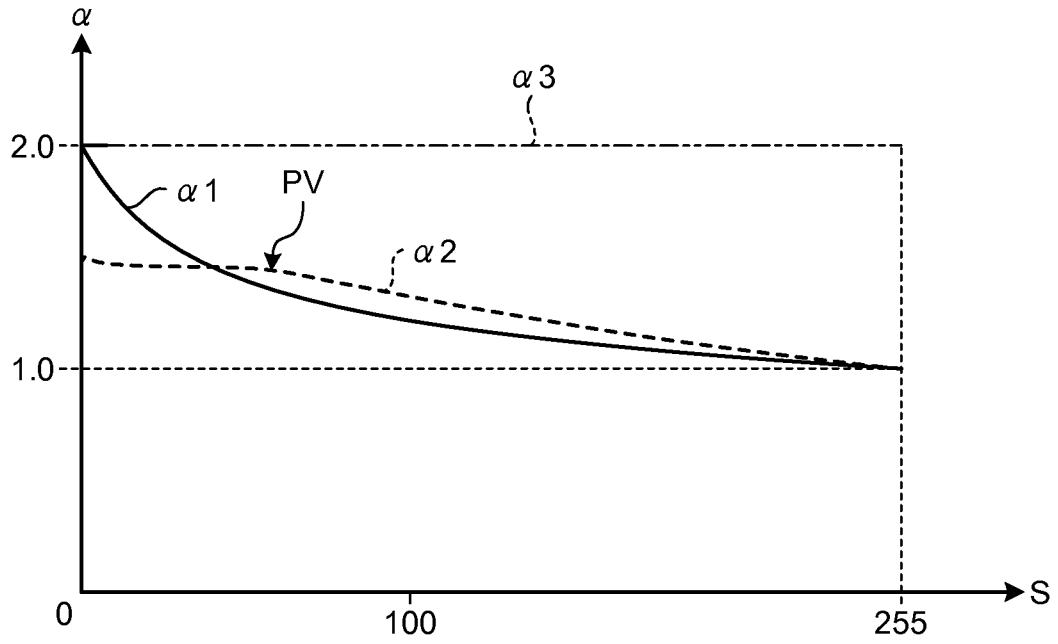
FIG. 13 is a diagram illustrating changes in the extension coefficient with the change in the saturation.

FIG. 13 is a diagram illustrating changes in the extension coefficient with the change in the saturation. FIG. 13 illustrates a plurality of relations each illustrating a relation between the extension coefficient α and the saturation S. The relation indicated by α1 between the extension coefficient α and the saturation S is a relation in which the extension coefficient α decreases as the saturation S increases, as described above. The relation indicated by α2 between the extension coefficient α and the saturation S is a relation in which the extension coefficient α increases as the saturation S slightly increases from 0, and thereafter decreases as the saturation S increases. The relation α2 has an inflection point PV. The relation indicated by α3 between the extension coefficient α and the saturation S is a relation in which the extension coefficient α is constant (2.0 in this example) regardless of change in the saturation S.

In the embodiment, the display device 10 illustrated in FIG. 1 and the driving method thereof may include a plurality of relations between the extension coefficient α and the saturation S of the input signal, and may use the relations by switching thereamong. For example, the display device 10 can store, for example, α1, α2, and α3 described above in a storage unit, and use them by switching thereamong according to conditions. Doing this allows to select and use an appropriate relation between the extension coefficient α and the saturation S according to, for example, change of the image display panel 30 with time, and thereby allows to suppress the display quality deterioration more effectively.

In the embodiment, the display device 10 illustrated in FIG. 1 and the driving method thereof may switch, according to illuminance around the display device 10, between a first display mode in which the extension coefficient α changes based on the saturation S of the input signal and a second display mode in which the extension coefficient α is kept at a constant value. The relation between the extension coefficient α and the saturation S of the input signal used in the first display mode is, for example, α1 of FIG. 13. The relation between the extension coefficient α and the saturation S of the input signal used in the second display mode is, for example, α2 of FIG. 13.

Although the display quality of the image display panel 30 included in the display device 10 can deteriorate when the extension coefficient α is constant regardless of the saturation S, the display quality deterioration of the image display panel 30 is hardly visible when, for example, it is very bright, that is, the illuminance is very high, around the display device 10. This allows the display device 10 to achieve high luminance display by using the second display mode when it is very bright around the display device 10. Because the display device 10 can perform display at a high luminance level when used at a very bright place, the display device 10 can consequently improve the visibility.

3-3. Modification

In general, human sensitivity is particularly high to the display quality deterioration of a yellowish picture. Therefore, the hue H may be taken into consideration. A modification of the embodiment changes the extension coefficient α based on the saturation S and the hue H of the input signal. The present modification uses Equations (13) to (15) to define the hue. Specifically, the hue H is given by Equation (13) when the value of R is the maximum of (R, G, B), by Equation (14) when the value of G is the maximum of (R, G, B), or by Equation (15) when the value of B is the maximum of (R, G, B). Min represents min(Rin, Gin, Bin) described above, and Max represents max(Rin, Gin, Bin) described above. The definitions of the hue H are not limited to these equations.

$$H=60\cdot(G-B)/(\text{Max}-\text{Min}) \tag{13}$$

$$H=60\cdot(B-R)/(\text{Max}-\text{Min})+120 \tag{14}$$

$$H=60\cdot(R-G)/(\text{Max}-\text{Min})+240 \tag{15}$$

The present modification defines a range in which the hue H=40 to 80 as a range of yellow. The hue H representing yellow is not limited to this range. The display device 10 controls the extension coefficient α for an input signal giving the hue H corresponding to yellow so as to change based on the saturation S of the input signal (for example, like α1 of FIG. 13). The display device 10 controls the extension coefficient α for an input signal giving a hue other than yellow, that is, other than the hue H from 40 to 80 so as to be constant regardless of the saturation S (for example, like α3 of FIG. 13). In other words, the display device 10 selects the above-described first display mode when the hue H of the input signal is yellow, and selects the above-described second display mode when the hue H of the input signal is other than yellow.

Based on the hue H, the present modification uses, in the case of yellow, the first display mode in which the extension coefficient α changes, and uses, in the case of other than yellow, the second display mode in which the extension coefficient α is constant. This results that the extension coefficient α varies based on the hue H. In the first display mode, the extension coefficient α varies based on the saturation S. In this manner, the extension coefficient α varies based on at least one of the saturation S and the hue H of the input signal.

Following the way of the present modification allows the present modification to extend the input signal while effectively suppressing the display quality deterioration with respect to yellow in which the display quality deterioration is more visible relative to human sensitivity. The present modification keeps the extension coefficient α constant regardless of the saturation S with respect to the hue in which the display quality deterioration is hardly visible, that is, the hue other than yellow. Thus, the luminance can be further improved. This results in allowing the present modification to output a video picture in which the display quality deterioration is hardly visible, and that has high luminance.

As described above, the present embodiment and the modification thereof change the extension coefficient α based on at least the saturation S of the input signal, and thus can reduce the display quality deterioration and provide an image or a video picture having higher luminance. As a result, the embodiment and the modification thereof can suppress a reduction in the visibility of the display device and reduce the display quality deterioration of the display device, under outside light. The embodiment and the modification thereof are particularly effective for reducing the display quality deterioration on the high-saturation side.

The modification changes the extension coefficient α based on the hue H of the input signal to enable improvement in the luminance while suppressing the display quality deterioration in the color, such as yellow, in which the display quality deterioration is easily visible, and thus to suppress the reduction in the visibility under outside light. Otherwise, the modification changes the extension coefficient α based on the saturation S and the hue H of the input signal to enable suppression of the display quality deterioration in the color (such as yellow) in which the display quality deterioration is easily visible, and on the high-saturation side. The luminance can also be improved so as to suppress the reduction in the visibility. The embodiment and the modification thereof are particularly preferable to provide display under outside light in outdoors. Because the embodiment and the modification thereof change the extension coefficient α according to the saturation S, an image displayed on the image display panel 30 of the display device 10 may have the extension coefficient α that varies depending on the position.

4. Application Examples

A description will be made of application examples of the present disclosure in which the above-described display device 10 is applied to an electronic apparatus.

FIGS. 14 to 25 are diagrams each illustrating an example of the electronic apparatus including the display device according to the embodiment. The display device 10 can be applied to electronic apparatuses of all fields, such as television devices, digital cameras, notebook type personal computers, mobile terminal devices including mobile phones, and video cameras. In other words, the display device 10 can be applied to electronic apparatuses of all fields that display externally received video signals or internally generated video signals as images or video pictures.

Application Example 1

Figure 14:
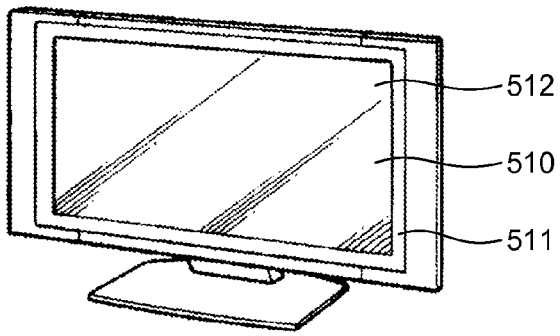
FIG. 14 is a diagram illustrating an example of an electronic apparatus including the display device according to the embodiment.

The electronic apparatus illustrated in FIG. 14 is a television device to which the display device 10 is applied. This television device includes, for example, a video display screen unit 510 that includes a front panel 511 and a filter glass 512. The display device 10 is applied to the video display screen unit 510. It means that the screen of the television device has a function to detect touch operations in addition to a function to display images.

Application Example 2

Figure 15:
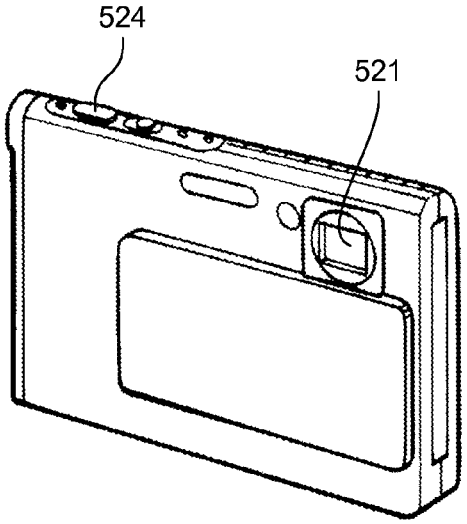
FIG. 15 is a diagram illustrating an example of the electronic apparatus including the display device according to the embodiment.
Figure 16:
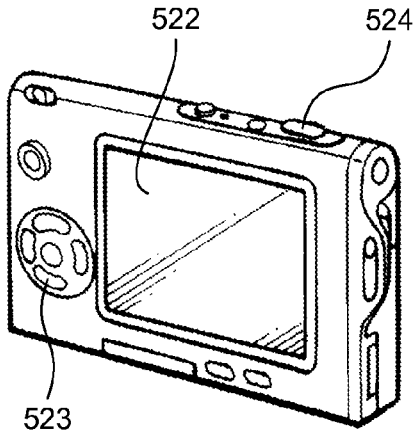
FIG. 16 is a diagram illustrating an example of the electronic apparatus including the display device according to the embodiment.

The electronic apparatus illustrated in FIGS. 15 and 16 is a digital camera to which the display device 10 is applied. This digital camera includes, for example, a light-emitting unit 521 for flash, a display unit 522, a menu switch 523, and a shutter button 524. The display device 10 is applied to the display unit 522. Therefore, the display unit 522 of the digital camera has the function to detect touch operations in addition to the function to display images.

Application Example 3

Figure 17:
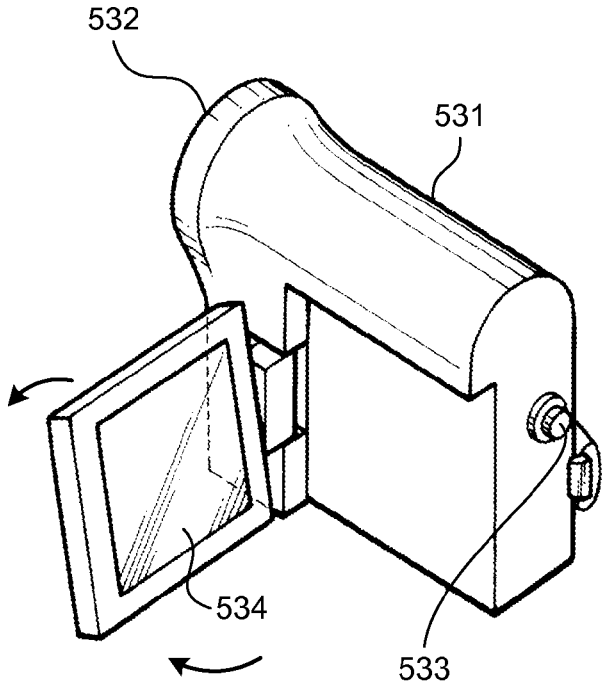
FIG. 17 is a diagram illustrating an example of the electronic apparatus including the display device according to the embodiment.

The electronic apparatus illustrated in FIG. 17 represents an external appearance of a video camera to which the display device 10 is applied. This video camera includes, for example, a body 531, a lens 532 for capturing a subject provided on the front side face of the body 531, and a start/stop switch 533 and a display unit 534 that are used during shooting. The display device 10 is applied to the display unit 534. Therefore, the display unit 534 of the video camera has the function to detect touch operations in addition to the function to display images.

Application Example 4

Figure 18:
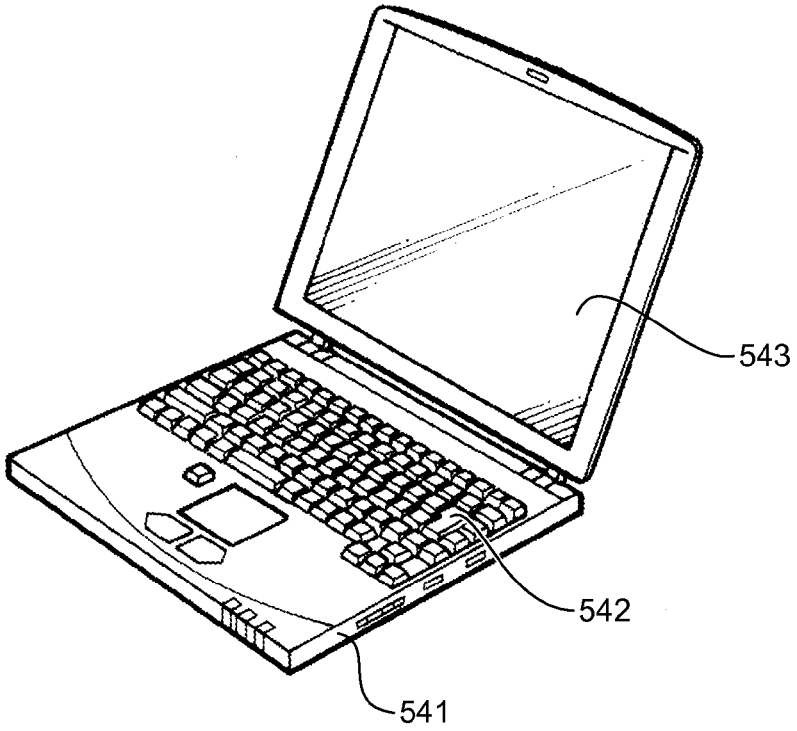
FIG. 18 is a diagram illustrating an example of the electronic apparatus including the display device according to the embodiment.
Figure 19:
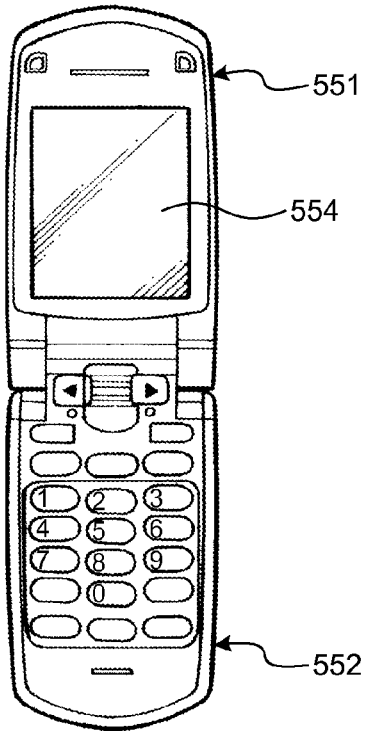
FIG. 19 is a diagram illustrating an example of the electronic apparatus including the display device according to the embodiment.
Figure 20:
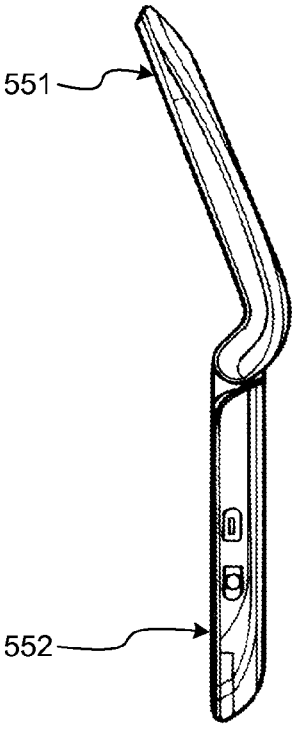
FIG. 20 is a diagram illustrating an example of the electronic apparatus including the display device according to the embodiment.
Figure 21:
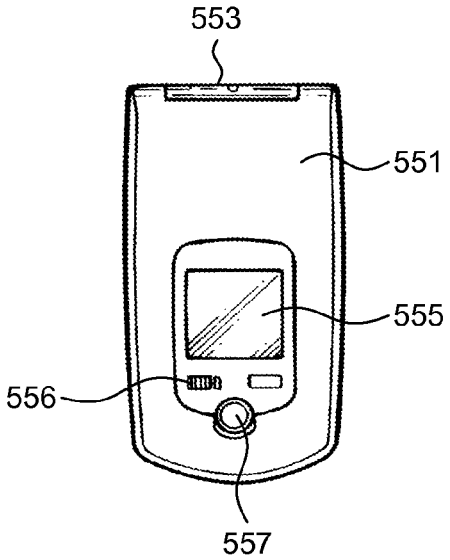
FIG. 21 is a diagram illustrating an example of the electronic apparatus including the display device according to the embodiment.
Figure 22:
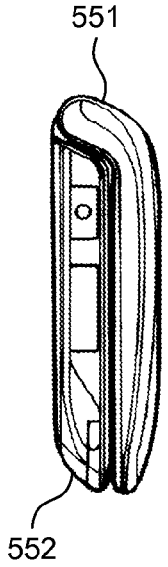
FIG. 22 is a diagram illustrating an example of the electronic apparatus including the display device according to the embodiment.
Figure 23:
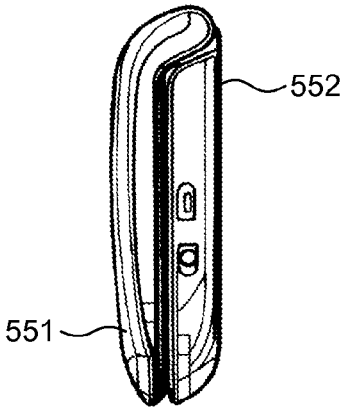
FIG. 23 is a diagram illustrating an example of the electronic apparatus including the display device according to the embodiment.
Figure 24:
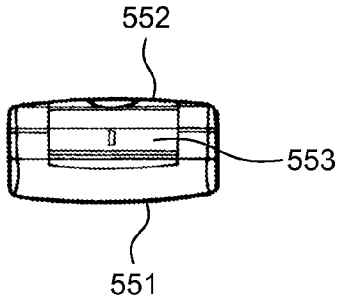
FIG. 24 is a diagram illustrating an example of the electronic apparatus including the display device according to the embodiment.
Figure 25:
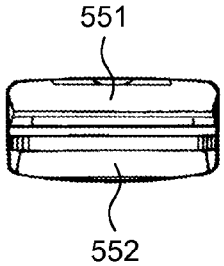
FIG. 25 is a diagram illustrating an example of the electronic apparatus including the display device according to the embodiment.

The electronic apparatus illustrated in FIG. 18 is a notebook type personal computer to which the display device 10 is applied. This notebook type personal computer includes, for example, a body 541, a keyboard 542 for input operation of characters, etc., and a display unit 543 that displays images. The display device 10 is applied to the display unit 543. Therefore, the display unit 543 of the notebook type personal computer has the function to detect touch operations in addition to the function to display images.

Application Example 5

The electronic apparatus illustrated in FIGS. 19 to 25 is a mobile phone to which the display device 10 is applied. This mobile phone is, for example, composed of an upper housing 551 and a lower housing 552 connected to each other by a connection unit (hinge unit) 553, and includes a display 554, a subdisplay 555, a picture light 556, and a camera 557. The display device 10 is mounted as the display 554. Therefore, the display 554 of the mobile phone has the function to detect touch operations in addition to the function to display images.

Application Example 6

Figure 26:
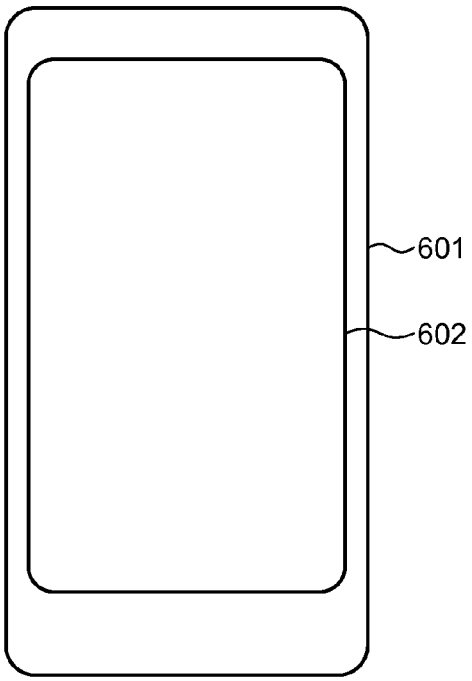
FIG. 26 is a diagram illustrating an example of the electronic apparatus including the display device according to the embodiment.

The electronic apparatus illustrated in FIG. 26 is a mobile phone that is commonly called a smartphone to which, for example, a touch detection device 1 or 1A is applied. This mobile phone includes, for example, a touch panel 602 on a surface of a substantially rectangular thin plate-like housing 601. The touch panel 602 includes the touch detection device 1 or 1A.

5. Aspects of Disclosure

The present disclosure includes following aspects.

(1) A display device comprising:

a first sub-pixel;

a second sub-pixel;

a third sub-pixel; and a fourth sub-pixel, wherein a signal obtained based on at least an input signal for the first sub-pixel and an extension coefficient is supplied to the first sub-pixel, a signal obtained based on at least an input signal for the second sub-pixel and the extension coefficient is supplied to the second sub-pixel, a signal obtained based on at least an input signal for the third sub-pixel and the extension coefficient is supplied to the third sub-pixel, a signal obtained based on at least the input signal for the first sub-pixel, the input signal for the second sub-pixel, the input signal for the third sub-pixel, and the extension coefficient is supplied to the fourth sub-pixel, and the extension coefficient varies based on at least a saturation of the input signals.

(2) The display device according to (1), wherein the extension coefficient varies based on a hue of the input signals, in addition to the saturation thereof.

(3) The display device according to (1), further comprising:

a storage unit that stores a plurality of relations between the extension coefficient and the saturation of the input signals; and a processing unit that switches a relation to be used for determining the extension coefficient corresponding to the saturation of the input signals, among the relations stored in the storage unit.

(4) The display device according (1), wherein the extension coefficient decreases as the saturation of the input signals increases.

(5) The display device according to (1), wherein further comprising a processing unit that switches between a first display mode in which the extension coefficient is changed based on the saturation of the input signals and a second display mode in which the extension coefficient is kept at a constant value regardless of the saturation of the input signals.

(6) The display device according to (5), wherein the switching is made between the first display mode and the second display mode based on the hue of the input signals.

(7) The display device according to (6), wherein the first display mode is selected when the hue of the input signals is yellow, and the second display mode is selected when the hue of the input signals is other than yellow.

(8) A driving method of a display device that comprises a first sub-pixel, a second sub-pixel, a third sub-pixel, and a fourth sub-pixel, the driving method comprising:

supplying a signal obtained based on at least an input signal for the first sub-pixel and an extension coefficient to the first sub-pixel;

supplying a signal obtained based on at least an input signal for the second sub-pixel and the extension coefficient to the second sub-pixel;

supplying a signal obtained based on at least an input signal for the third sub-pixel and the extension coefficient to the third sub-pixel;

supplying a signal obtained based on at least the input signal for the first sub-pixel, the input signal for the second sub-pixel, the input signal for the third sub-pixel, and the extension coefficient to the fourth sub-pixel; and changing the extension coefficient based on at least a saturation of the input signals.

(9) The driving method of a display device according to (8), wherein the extension coefficient is changed based on a hue of the input signals, in addition to the saturation thereof.

(10) The driving method of a display device according to (8), further comprising switching a relation to be used for determining the extension coefficient corresponding to the saturation of the input signals, among a plurality of relations between the extension coefficient and the saturation of the input signals.

(11) The driving method of a display device according to claim 8, wherein the extension coefficient decreases as the saturation of the input signals increases.

(12) The driving method of a display device according to (8), further comprising switching between a first display mode in which the extension coefficient changes based on the saturation of the input signals and a second display mode in which the extension coefficient is kept at a constant value regardless of the saturation of the input signals.

(13) The driving method of a display device according to (12), wherein the switching is made between the first display mode and the second display mode based on the hue of the input signals.

(14) The driving method of a display device according to (13), wherein the first display mode is selected when the hue of the input signals is yellow, and the second display mode is selected when the hue of the input signals is other than yellow.

(15) An electronic apparatus comprising:

a first sub-pixel;

a second sub-pixel;

a third sub-pixel;

a fourth sub-pixel; and a processing unit configured to supply a signal obtained based on at least an input signal for the first sub-pixel and an extension coefficient to the first sub-pixel, supply a signal obtained based on at least an input signal for the second sub-pixel and the extension coefficient to the second sub-pixel, supply a signal obtained based on at least an input signal for the third sub-pixel and the extension coefficient to the third sub-pixel, supply a signal obtained based on at least the input signal for the first sub-pixel, the input signal for the second sub-pixel, the input signal for the third sub-pixel, and the extension coefficient is supplied to the fourth sub-pixel, and change the extension coefficient based on at least a saturation of the input signals.

The display device and the driving method thereof of the present disclosure change the extension coefficient based on at least the saturation of an input signal, and thus can reduce the display quality deterioration and provide an image or a video picture having higher luminance. As a result, the display device and the driving method thereof of the present disclosure can suppress the reduction in the visibility of the display device and reduce the display quality deterioration of the display device, under outside light. The electronic apparatus of the present disclosure includes the display device of the present disclosure, and thus can suppress the reduction in the visibility of the display device and reduce the display quality deterioration of the display device when used under outside light.

One embodiment of the present disclosure can suppress can suppress a reduction in visibility of a display device and reduce display quality deterioration of the display device, under outside light.

While the present disclosure has been described above, the present disclosure is not limited to the above description. The constituent elements of the present disclosure described above include elements easily envisaged by those skilled in the art, substantially identical elements, and elements in the range of what are called equivalents. The above-described constituent elements can be combined as appropriate. The constituent elements can be omitted, replaced, and/or modified in various ways within the scope not deviating from the gist of the present disclosure.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a first sub-pixel;

a second sub-pixel;

a third sub-pixel;

a fourth sub-pixel, and a processing unit, wherein a signal obtained based on at least an input signal for the first sub-pixel and an extension coefficient is supplied to the first sub-pixel, a signal obtained based on at least an input signal for the second sub-pixel and the extension coefficient is supplied to the second sub-pixel, a signal obtained based on at least an input signal for the third sub-pixel and the extension coefficient is supplied to the third sub-pixel, a signal obtained based on at least the input signal for the first sub-pixel, the input signal for the second sub-pixel, the input signal for the third sub-pixel, and the extension coefficient is supplied to the fourth sub-pixel, the extension coefficient is configured to vary based on at least a saturation of the input signals, and the processing unit is configured to switch between a first display mode in which the extension coefficient is changed based on the saturation of the input signals and a second display mode in which the extension coefficient is kept at a constant value regardless of the saturation of the input signals.

2. The display device according to claim 1, wherein the switching is made between the first display mode and the second display mode based on the hue of the input signals.

3. The display device according to claim 2, wherein the first display mode is selected when the hue of the input signals is yellow, and the second display mode is selected when the hue of the input signals is other than yellow.

4. A driving method of a display device that comprises a first sub-pixel, a second sub-pixel, a third sub-pixel, and a fourth sub-pixel, the driving method comprising:

supplying a signal obtained based on at least an input signal for the first sub-pixel and an extension coefficient to the first sub-pixel;

supplying a signal obtained based on at least an input signal for the second sub-pixel and the extension coefficient to the second sub-pixel;

supplying a signal obtained based on at least an input signal for the third sub-pixel and the extension coefficient to the third sub-pixel;

supplying a signal obtained based on at least the input signal for the first sub-pixel, the input signal for the second sub-pixel, the input signal for the third sub-pixel, and the extension coefficient to the fourth sub-pixel;

changing the extension coefficient based on at least a saturation of the input signals; and switching between a first display mode in which the extension coefficient changes based on the saturation of the input signals and a second display mode in which the extension coefficient is kept at a constant value regardless of the saturation of the input signals.

5. The driving method of a display device according to claim 4, wherein the switching is made between the first display mode and the second display mode based on the hue of the input signals.

6. The driving method of a display device according to claim 5, wherein the first display mode is selected when the hue of the input signals is yellow, and the second display mode is selected when the hue of the input signals is other than yellow.

* * * * *